US009647352B2

(12) United States Patent
Sato et al.

(10) Patent No.: US 9,647,352 B2
(45) Date of Patent: May 9, 2017

(54) ELECTRIC WIRE WITH TERMINAL

(71) Applicants: YAZAKI CORPORATION, Minato-ku, Tokyo (JP); TOYOTA JIDOSHA KABUSHIKI KAISHA, Toyota-shi, Aichi-ken (JP)

(72) Inventors: Kei Sato, Makinohara (JP); Hiroshi Aoki, Makinohara (JP); Takahito Nakashima, Okazaki (JP); Hiroshi Kobayashi, Okazaki (JP); Hiroyasu Taga, Toyota (JP)

(73) Assignees: Yazaki Corporation, Tokyo (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/030,215

(22) PCT Filed: Oct. 17, 2014

(86) PCT No.: PCT/JP2014/077737
§ 371 (c)(1),
(2) Date: Apr. 18, 2016

(87) PCT Pub. No.: WO2015/072283
PCT Pub. Date: May 21, 2015

(65) Prior Publication Data

US 2016/0261054 A1 Sep. 8, 2016

(30) Foreign Application Priority Data

Nov. 13, 2013 (JP) ..... 2013-234727

(51) Int. Cl.
*H01R 4/02* (2006.01)
*H01R 4/70* (2006.01)
(Continued)

(52) U.S. Cl.
CPC ..... *H01R 4/70* (2013.01); *H01R 4/185* (2013.01); *H01R 4/62* (2013.01); *H01R 13/405* (2013.01)

(58) Field of Classification Search
None
See application file for complete search history.

(56) References Cited

U.S. PATENT DOCUMENTS 4,029,388 A * 6/1977 Knoll ..... H01R 13/405 249/96
5,108,317 A * 4/1992 Beinhaur ..... H01R 43/24 264/274
(Continued)

FOREIGN PATENT DOCUMENTS

JP 11-260527 A 9/1999
JP 2001-162647 A 6/2001
(Continued)

OTHER PUBLICATIONS

International Search Report dated Dec. 22, 2014 issued by the International Searching Authority in counterpart International Application No. PCT/JP2014/077737 (PCT/ISA/210).
(Continued)

*Primary Examiner* — Tho D Ta
(74) *Attorney, Agent, or Firm* — Sughrue Mion, PLLC

(57) ABSTRACT

Provided is an electric wire with a terminal (1), in which a resin portion (4) molded by a die covers a conductor exposure portion of a terminal (3) to which a conductor is connected. At least groove portion (16) is provided at a part of the terminal (3) covered with the resin portion (4) so that the groove portion (16) prevents the resin portion (4) from separating from the terminal (3) in a removing direction of the die after the resin portion (4) is molded by the die.

10 Claims, 16 Drawing Sheets

(51) Int. Cl.

| | |
|---|---|
| ***H01R 4/18*** | (2006.01) |
| ***H01R 4/62*** | (2006.01) |
| *H01R 13/405* | (2006.01) |

(56) References Cited

U.S. PATENT DOCUMENTS

| | | | | |
|---|---|---|---|---|
| 6,206,735 | B1 * | 3/2001 | Zanolli | H01R 12/585 439/404 |
| 6,290,552 | B1 * | 9/2001 | Saito | H01M 2/206 439/736 |
| 6,517,381 | B2 * | 2/2003 | Kondo | H01R 4/70 439/604 |
| 8,622,774 | B2 * | 1/2014 | Seifert | H01R 4/185 439/882 |
| 8,771,015 | B2 * | 7/2014 | Inoue | H01R 4/70 439/604 |
| 2001/0003687 | A1 | 6/2001 | Kondo | |
| 2002/0027013 | A1 | 3/2002 | Kondo | |
| 2002/0053458 | A1 | 5/2002 | Kondo | |
| 2013/0133946 | A1 | 5/2013 | Morikawa et al. | |
| 2013/0252459 | A1 | 9/2013 | Tanaka et al. | |
| 2015/0132993 | A1 | 5/2015 | Osada et al. | |

FOREIGN PATENT DOCUMENTS

| | | | |
|---|---|---|---|
| JP | 2001-167821 | A | 6/2001 |
| JP | 2003-217703 | A | 7/2003 |
| JP | 2007-227163 | A | 9/2007 |
| JP | 2010-108828 | A | 5/2010 |
| JP | 2012-129178 | A | 7/2012 |
| JP | 2013-098161 | A | 5/2013 |
| WO | 2012023314 | A1 | 2/2012 |
| WO | 2014/017614 | A1 | 1/2014 |

OTHER PUBLICATIONS

Written Opinion dated Dec. 22, 2014 issued by the International Searching Authority in counterpart International Application No. PCT/JP2014/077737 (PCT/ISA/237).

English translation issued on Dec. 22, 2014, by the International Searching Authority in counterpart International Application No. PCT/JP2014/077737.

* cited by examiner

ELECTRIC WIRE WITH TERMINAL

TECHNICAL FIELD

The present invention relates to an electric wire with a terminal.

BACKGROUND ART

Conventionally, in automobiles, home electronics appliances, etc., signal lines and power lines are used in which an electric wire having a core wire made of a copper material is connected to a terminal also made of a copper material. On the other hand, in the automobile industry, in consideration of influences on the environment, it is an important issue to increase the fuel efficiency by making vehicles lighter. For this reason, attention is now paid to electric wires in which aluminum or an aluminum alloy (hereinafter referred to as "aluminum" simply) which is lighter in weight than copper is used as a material of a core wire. However, aluminum is prone to electrolytic corrosion under the presence of water and copper ions. That is, there is a problem that if water enters a connection portion of an aluminum core wire and a copper terminal. In view of this, a terminal-attached electric wire has been proposed that prevents occurrence of electric corrosion by covering a connection portion of an aluminum core wire and a copper terminal with resin (refer to Patent document 1).

In the terminal-attached electric wire disclosed in Patent document 1, a terminal is crimped onto a conductor portion that is exposed by removing an insulation covering at an end portion of a covered wire. This terminal-attached electric wire is set in a molding die consisting of, for example, upper and lower dies and resin is injected into a cavity formed in the molding die. As a result, the conductor-exposed portion is covered with the resin at the connection portion of the conductor and the terminal. A resin portion is formed as a result of solidification of the resin.

RELATED ART DOCUMENTS

Patent Document

Patent Document 1: JP-A-2001-167821

SUMMARY OF THE INVENTION

Problems to be Solved by the Invention

According to the electric wire with the terminal in the aforementioned background-art technique, it is necessary to bring the resin portion into close contact with the terminal in order to prevent occurrence of electrolytic corrosion. However, when close contact force of the resin portion to the terminal is too strong during molding of the resin portion, the resin portion may adhere to not the terminal side but the molding die side to therefore make production difficult. For this reason, it is necessary to weaken the close contact force between the resin portion and the terminal to some extent.

In the case where the close contact force between the resin portion and the terminal is weakened, there is however an antinomic problem that the resin portion may separate from the terminal when external force acts on the resin portion. Particularly, when the die is removed from the electric wire with the terminal after the resin portion is molded, there is a problem that the resin portion may separate from the terminal in a removing direction of the die. That is, the aforementioned background-art technique lacks a solution to the foregoing problem.

The invention has been therefore accomplished in consideration of the aforementioned circumstances. It is an object of the invention to provide an electric wire with a terminal, in which a resin portion can be prevented from separating from a terminal.

Solution to Problem

The foregoing object of the invention will be achieved by the following configurations.

(1) An electric wire with a terminal, in which a resin portion molded by a die covers a conductor exposure portion of a terminal to which a conductor is connected, wherein: at least a separation preventing portion is provided at a part of the terminal covered with the resin portion so that the separation preventing portion prevents the resin portion from separating from the terminal in a removing direction of the die after the resin portion is molded by the die.

According to the electric wire with the terminal having the aforementioned configuration (1), the separation preventing portion is provided at the part of the terminal covered with the resin portion. Accordingly, the separation preventing portion can resist against the resin portion which tends to separate from the terminal when external force acts on the resin portion.

(2) The electric wire with the terminal according to the aforementioned configuration (1), wherein the separation preventing portion is provided in a side wall or a bottom wall of the terminal at the part covered with the resin portion.

According to the electric wire with the terminal having the aforementioned configuration (2), the separation preventing portion is provided in the side wall provided erectly in the removing direction of the die or in the bottom wall formed perpendicularly to the removing direction of the die. Accordingly, the separation preventing portion can satisfactorily resist against the resin portion which tends to separate from the terminal when external force acts on the resin portion.

(3) The electric wire with the terminal according to the aforementioned configuration (2), wherein the separation preventing portion includes a groove portion or a protrusion portion which is formed to have a width in the removing direction of the die and to be longer in a direction intersecting with the removing direction of the die than the width.

According to the electric wire with the terminal having the aforementioned configuration (3), when the groove portion is provided as the separation preventing portion, the resin enters the groove portion so that the resin portion is formed inside the groove portion. In addition, when the protrusion portion is provided as the separation preventing portion, the resin portion is formed as if the protrusion portion were put between parts of the resin portion. In this manner, the resin portion is hooked to the groove portion or the protrusion portion. Accordingly, the resin portion can be prevented from separating from the terminal even when external force acts on the resin portion. In addition, the groove portion or the protrusion portion is provided to have a width in the removing direction of the die and to be longer in the direction intersecting the removing direction of the die than the width. In this manner, in the groove portion or the protrusion portion, a segment where the resin portion tending to separate in the removing direction of the die is hooked is wider than in a case where a groove portion or a protrusion portion is provided to have a length in a removing direction of a die and a width in a direction intersecting the removing direction of the die, the length being longer than the width. Accordingly, the groove portion or the protrusion portion can satisfactorily resist against the resin portion which tends to separate from the terminal in the removing direction of the die.

(4) The electric wire with the terminal according to the aforementioned configuration (2), wherein the separation preventing portion includes a bent portion which is formed by bending a front end of the side wall inward.

According to the electric wire with the terminal having the aforementioned configuration (4), the bent portion formed by bending the front end of the side wall inward is provided as the separation preventing portion. Accordingly, when the resin portion is formed, the resin is also present on a lower side of the bent portion. In this manner, the resin portion is hooked to the bent portion. Accordingly, the resin portion can be prevented from separating from the terminal even when external force acts on the resin portion. In addition, the bent portion is provided as if the bent portion covered the resin present inside the terminal. In this manner, the bent portion serves as a portion where the resin portion tending to separate from the terminal in the removing direction of the die is hooked. Accordingly, the bent portion can satisfactorily resist against the resin portion which tends to separate from the terminal in the removing direction of the die.

(5) The electric wire with the terminal according to the aforementioned configuration (2), wherein the separation preventing portion has an opening portion which is bored and formed in the side wall.

According to the electric wire with the terminal having the aforementioned configuration (5), the opening portion which is bored and formed in the side wall is provided as the separation preventing portion. Accordingly, when the resin portion is formed, the resin is also present inside the opening portion. In this manner, the resin portion is hooked to the opening portion. Accordingly, the resin portion can be prevented from separating from the terminal even when external force acts on the resin portion. In addition, the opening portion is provided in the side wall provided erectly in the removing direction of the die. Accordingly, the opening portion can satisfactorily resist against the resin portion which tends to separate from the terminal in the removing direction of the die.

In addition, according to the aforementioned configuration (5), the separation preventing portion can be provided by just boring and forming an opening portion in the side wall.

(6) The electric wire with the terminal according to the aforementioned configuration (2), wherein the separation preventing portion has an opening portion which is bored and formed in the bottom wall, and the resin portion is formed so as to enter the opening portion, and formed to cover an outer face of the bottom wall.

According to the electric wire with the terminal having the aforementioned configuration (6), the opening portion which is bored and formed in the bottom wall is provided as the separation preventing portion. Accordingly, the resin portion is formed to forcibly enter the opening portion and formed to also cover the outer face of the bottom wall. In this manner, the resin portion covers an inner face of the bottom wall, and forcibly enters the opening portion to further cover the outer face of the bottom wall. With this arrangement, the resin portion is formed as if the bottom wall were put between the resin portion covering the inner face of the bottom wall and the resin portion covering the outer face of the bottom wall, with the result that the resin portion is hooked to the bottom wall. Accordingly, the resin portion is hooked to the bottom wall so that the resin portion can be prevented from separating from the terminal even when external force acts on the resin portion.

In addition, according to the aforementioned configuration (6), the separation preventing portion can be provided by just boring and forming an opening portion in the bottom wall.

(7) The electric wire with the terminal according to the aforementioned configuration (6), wherein a lock portion is formed into an arch shape so as to be joined to opposite ends of the opening portion.

According to the electric wire with the terminal having the aforementioned configuration (7), the lock portion which is formed into an arch so as to be joined to the opposite ends of the opening portion is provided as the separation preventing portion. In this manner, the resin portion is formed to forcibly enter the opening portion so that the lock portion can be locked to the resin portion. Accordingly, the resin portion can be prevented from separating from the terminal even when external force acts on the resin portion.

(8) The electric wire with the terminal according to any one of the aforementioned configurations (3), (4) and (5), wherein convex portions or concave portions are formed into a grid pattern in the bottom wall.

According to the electric wire with the terminal having the aforementioned configuration (8), the resin portion covers the convex portions or the concave portions. Accordingly, an area of the bottom wall in close contact with the resin portion increases. When the area of the bottom wall in close contact with the resin portion increases in this manner, close contact force of the resin portion to the terminal is improved. Accordingly, the resin portion can be satisfactorily suppressed from separating from the terminal even when external force acts on the resin portion.

Advantageous Effects of the Invention

According to the electric wire with the terminal stated in the aforementioned configuration (1), the separation preventing portion can resist against the resin portion which tends to separate from the terminal when external force acts on the resin portion. Consequently, it is possible to provide the electric wire with the terminal, in which the resin portion can be prevented from separating from the terminal.

According to the electric wire with the terminal stated in the aforementioned configuration (2), the separation preventing portion can satisfactorily resist against the resin portion which tends to separate from the terminal when external force acts on the resin portion. Consequently, it is possible to provide the electric wire with the terminal, in which the resin portion can be more surely prevented from separating from the terminal.

According to the electric wire with the terminal stated in the aforementioned configuration (3), the resin portion is hooked to the groove portion or the protrusion portion. Accordingly, the resin portion can be prevented from separating from the terminal even when external force acts on the resin portion. In addition, the groove portion or the protrusion portion is provided to have a width in the removing direction of the die and to be longer in the direction intersecting with the removing direction of the die than the width. Accordingly, the groove portion or the protrusion portion can satisfactorily resist against the resin portion which tends to separate from the terminal in the removing direction of the die. Consequently, it is possible to provide the electric wire with the terminal, in which the resin portion can be more surely prevented from separating from the terminal.

According to the electric wire with the terminal stated in the aforementioned configuration (4), the resin portion is hooked to the bent portion. Accordingly, the resin portion can be prevented from separating even when external force acts on the resin portion. In addition, the bent portion is provided as if the bent portion covered the resin present inside the terminal. Accordingly, the bent portion can satisfactorily resist against the resin portion which tends to separate from the terminal in the removing direction of the die. Consequently, it is possible to provide the electric wire with the terminal, in which the resin portion can be more surely prevented from separating from the terminal.

According to the electric wire with the terminal stated in the aforementioned configuration (5), the resin portion is hooked to the opening portion. Accordingly, the resin portion can be prevented from separating from the terminal even when external force acts on the resin portion. In addition, the opening portion is provided in the side wall which is provided erectly in the removing direction of the die. Accordingly, the opening portion can satisfactorily resist against the resin portion which tends to separate from the terminal in the removing direction of the die. Consequently, it is possible to provide the electric wire with the terminal, in which the resin portion can be more surely prevented from separating from the terminal.

In addition, according to the electric wire with the terminal stated in the aforementioned configuration (5), the separation preventing portion can be provided by just boring and forming an opening portion in the side wall. Accordingly, it is possible to obtain an effect that the separation preventing portion can be provided easily, in addition to the aforementioned effect.

According to the electric wire with the terminal stated in the aforementioned configuration (6), the resin portion covers the inner face of the bottom wall, and forcibly enters the opening portion to further cover the outer face of the bottom wall. Therefore, the resin portion is formed as if the bottom wall were put between the resin portion covering the inner face of the bottom wall and the resin portion covering the outer face of the bottom wall. In this manner, the resin portion is hooked to the bottom wall. With this arrangement, the resin portion can be prevented from separating from the terminal even when external force acts on the resin portion. Consequently, it is possible to provide the electric wire with the terminal, in which the resin portion can be more surely prevented from separating from the terminal.

In addition, according to the electric wire with the terminal stated in the aforementioned configuration (6), the separation preventing portion can be provided by just boring and forming an opening portion in the bottom wall. Accordingly, it is possible to obtain an effect that the separation preventing portion can be provided easily, in addition to the aforementioned effect.

According to the electric wire with the terminal stated in the aforementioned configuration (7), when the resin portion is formed to forcibly enter the opening portion, the lock portion is locked to the resin portion. Accordingly, the resin portion can be prevented from separating from the terminal even when external force acts on the resin portion. Consequently, it is possible to provide the electric wire with the terminal, in which the resin portion can be more surely prevented from separating from the terminal.

According to the electric wire with the terminal stated in the aforementioned configuration (8), the area of the bottom wall in close contact with the resin portion increases. Accordingly, close contact force of the resin portion to the terminal is improved so that the resin portion can be satisfactorily suppressed from separating from the terminal even when external force acts on the resin portion. Consequently, it is possible to provide the electric wire with the terminal, in which the resin portion can be more surely prevented from separating from the terminal.

MODE FOR CARRYING OUT THE INVENTION

Examples of the invention will be described below in detail with reference to FIG. 1(*a*) to FIG. 16(*b*).

EXAMPLE 1

Figure 1:
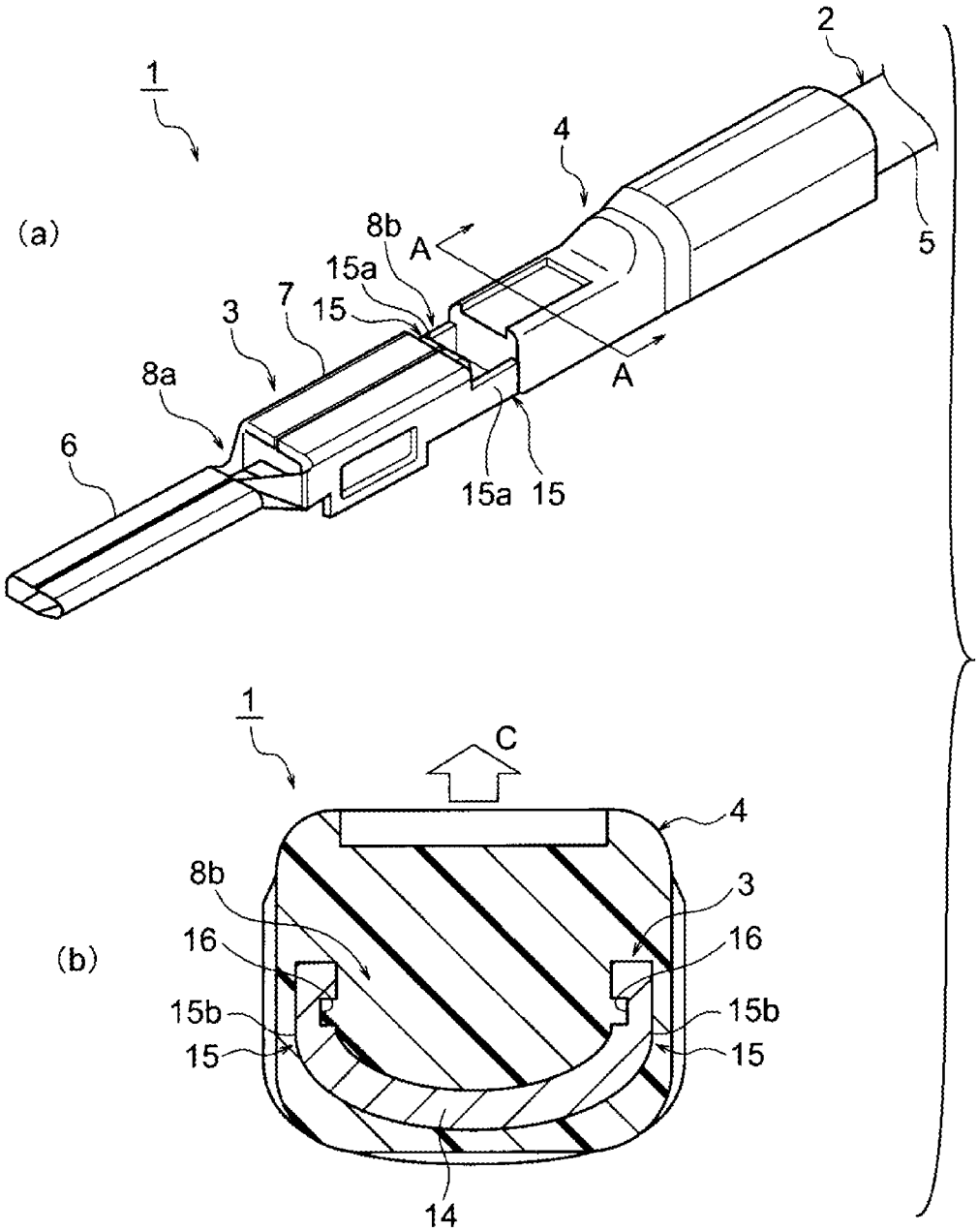
FIG. 1(*a*) is a perspective view showing Example 1 of an electric wire with a terminal according to the invention, and FIG. 1(*b*) is a sectional view taken along a line A-A in FIG. 1(*a*).
Figure 3:
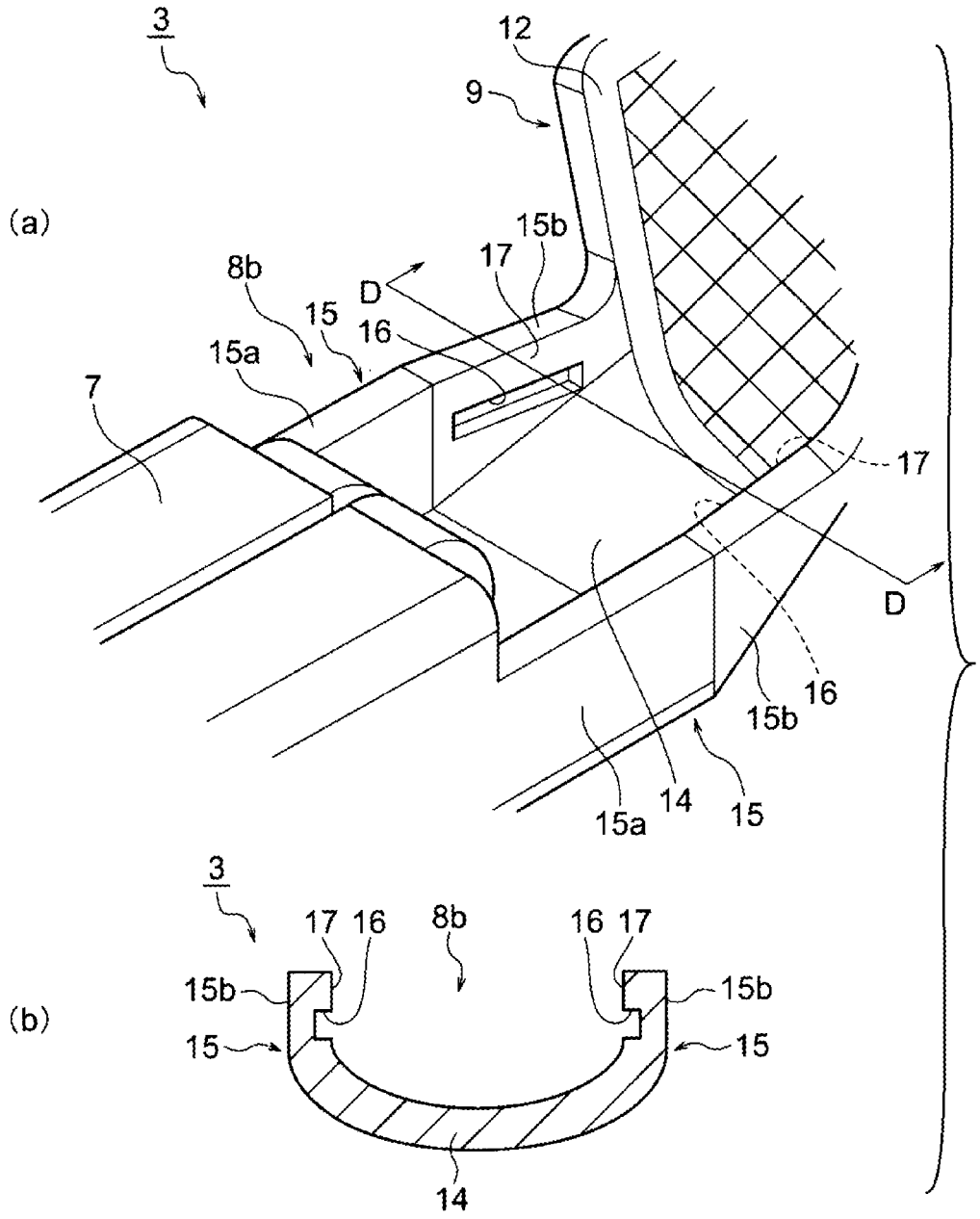
FIG. 3(*a*) is an enlarged perspective view of a portion indicated by an arrow B in FIG. 2, and FIG. 3(*b*) is a sectional view taken along a line D-D in FIG. 3(*a*).

Example 1 of an electric wire with a terminal according to the invention will be shown in FIG. 1(*a*) to FIG. 3(*b*).

Figure 2:
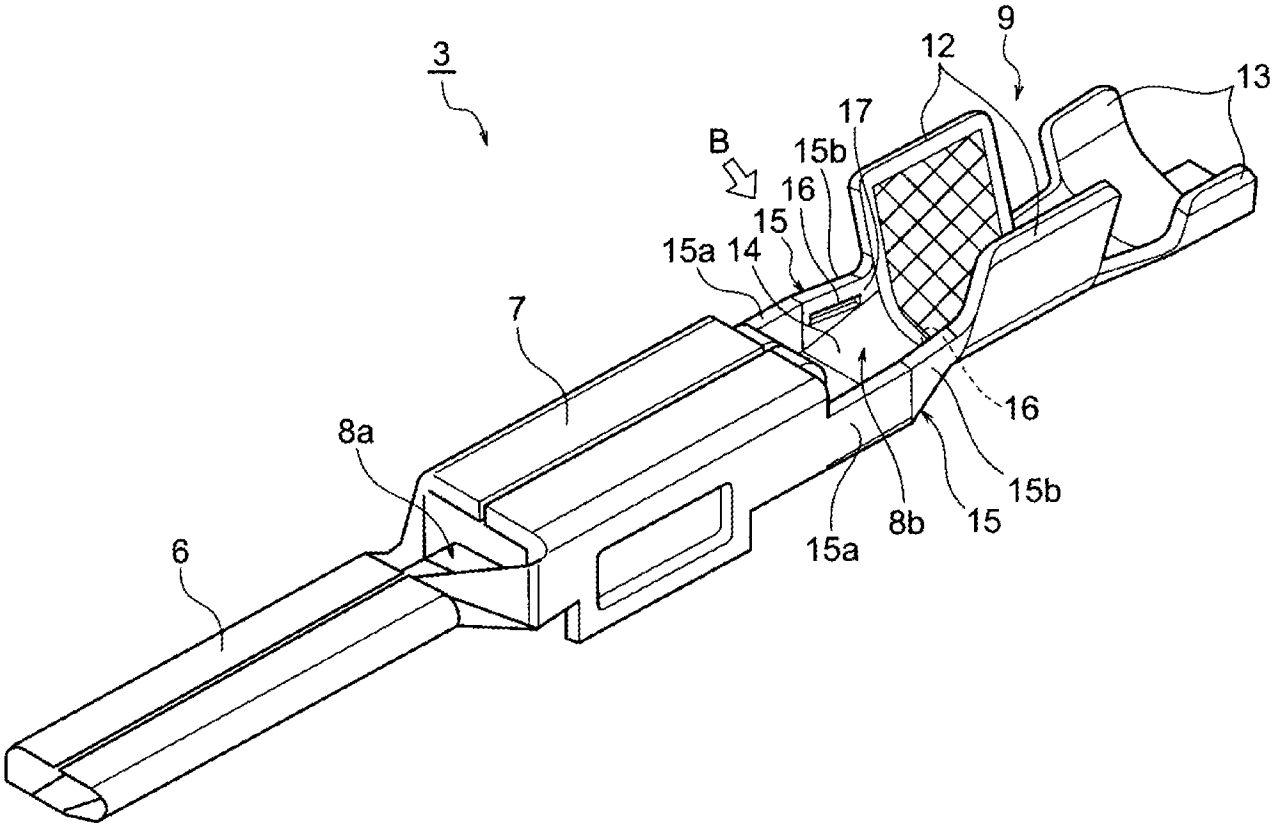
FIG. 2 is a perspective view of the terminal in FIG. 1(*a*).

FIG. 1(*a*) is a perspective view showing Example 1 of the electric wire with the terminal according to the invention. FIG. 1(*b*) is a sectional view taken along a line A-A in FIG. 1(*a*). FIG. 2 is a perspective view of the terminal in FIG. 1(*a*). FIG. 3(*a*) is an enlarged perspective view of a portion indicated by an arrow B in FIG. 2. FIG. 3(*b*) is a sectional view taken along a line D-D in FIG. 3(*a*).

As shown in FIGS. 1(*a*) and 1(*b*), the electric wire with the terminal 1 according to Example 1 is configured to include an electric wire 2, a terminal 3 and a resin portion 4. First, the respective constituents of the electric wire with the terminal 1 will be described.

The electric wire 2 is configured to include a conductor (not shown) and an insulating coating 5 applied onto the conductor. The conductor is manufactured by twisting a core wire made of aluminum.

As shown in FIG. 1(*a*) to FIG. 2, the terminal 3 is formed by pressing a copper plate. The terminal 3 in Example 1 serves as a male terminal (which is simply an example) which can be press-fitted into a connector housing (not shown). The terminal 3 is configured to include a terminal connection portion 6, a cylinder portion 7, a first connection portion 8*a*, a second connection portion 8*b*, and an electric wire connection portion 9. Incidentally, in the terminal 3 of the electric wire with the terminal 1 according to Example 1, a side where the terminal connection portion 6 is provided is defined as front end side, and a side where the electric wire connection portion 9 is provided is defined as rear end side.

The terminal connection portion 6 is formed into a shape which is narrow, long and straight. The terminal connection portion 6 is formed as a portion connected to a female terminal (not shown) serving as a partner side.

The cylinder portion 7 is provided on a rear end side of the terminal connection portion 6. The cylinder portion 7 is formed substantially into a box shape in accordance with the shape of a terminal receiving chamber (not shown) formed inside the connector housing.

The first connection portion 8*a* is provided as a portion through which the terminal connection portion 6 and the cylinder portion 7 are coupled to each other. The first connection portion 8*a* is formed to be wider toward the rear end side.

The electric wire connection portion 9 is provided on a rear end side of the cylinder portion 7. The electric wire connection portion 9 is provided for electrically connecting the electric wire 2 and the terminal 3 to each other. The electric wire connection portion 9 is provided with a pair of first caulking portions 12 and a pair of second caulking portions 13. The pair of first caulking portions 12 are provided on a front end side of the electric wire connection portion 9. The pair of first caulking portions 12 are formed into a belt plate shape. The pair of first caulking portions 12 are formed to be curved so that opposite side ends of the first caulking portions 12 can be raised toward an upper side of the terminal 3. The pair of first caulking portions 12 are provided as portions to which the conductor of the electric wire 2 can be crimped by caulking. The pair of second caulking portions 13 are provided on a rear end side of the electric wire connection portion 9. The pair of second caulking portions 13 are formed into a belt plate shape. The pair of second caulking portions 13 are formed to be curved so that opposite end sides of the second caulking portions 13 can be raised toward the upper side of the terminal 3. The pair of second caulking portions 13 are provided as portions to which a part of the electric wire 2 covered with the insulating coating 5 can be crimped by caulking.

As shown in FIG. 2 to FIG. 3(*b*), the second connection portion 8*b* is provided as a portion through which the cylinder portion 7 and the electric wire connection portion 9 are couple to each other. The second connection portion 8*b* includes a bottom wall 14 and a pair of side walls 15 which are provided erectly from opposite side ends of the bottom wall 14. The bottom wall 14 and the pair of side walls 15 are formed continuously to the cylinder portion 7 and the electric wire connection portion 9.

The pair of side walls 15 include a pair of parallel side walls 15*a* and a pair of slope side walls 15*b*. The pair of parallel side walls 15*a* each shaped like a belt plate are formed continuously to the rear end of the cylinder portion 7. The pair of parallel side walls 15*a* are disposed oppositely so as to be parallel to each other at a predetermined interval therebetween. The pair of slope side walls 15*b* are formed continuously to rear ends of the pair of parallel side walls 15*a*. In addition, the pair of slope side walls 15*b* each shaped like a belt plate are formed continuously to the front end of the electric wire connection portion 9. The pair of slope side walls 15*b* are formed to have a narrower interval from each other toward the rear end.

Groove portions (separation preventing portions) 16 are formed in inner faces 17 of the pair of slope side walls 15*b*. The groove portions 16 are formed to have a predetermined depth from the inner faces 17 of the pair of slope side walls 15*b*. As shown in FIG. 3(*b*), the section of each groove portion 16 is formed into a concave shape. As shown in FIG. 2 and FIG. 3(*a*), the groove portion 16 is formed into a rectangular shape with a narrow and long opening. The groove portion 16 is formed so that the length of the groove portion 16 in a direction (i.e. a direction penetrating the paper of FIG. 1(*b*) from the front to the back) intersecting a removing direction of a die indicated by an arrow C is longer than the width of the groove portion 16 in the removing direction of the die as shown in FIG. 1(*b*).

As shown in FIGS. 1(*a*) and 1(*b*), the resin portion 4 is provided to cover a conductor exposure portion (not shown) at a connection part between the conductor of the electric wire 2 and the terminal 3 in the state in which the electric wire 2 and the terminal 3 are connected to each other, to thereby prevent electrolytic corrosion which may occur when water invades the connection part between the conductor and the terminal 3. The resin portion 4 is formed to cover a range from the pair of slope side walls 15*b* of the second connection portion 8*b* to a terminal end portion of the electric wire 2. Further, the resin portion 4 completely covers the outer circumference of the range from the pair of slope side walls 15*b* of the second connection portion 8*b* to the terminal end portion of the electric wire 2 in the electric wire with the terminal 1.

As shown in FIG. 1(*b*), the resin portion 4 is formed to cover the pair of slope side walls 15*b* of the second connection portion 8*b*. Accordingly, the resin portion 4 is also formed inside the groove portions 16. That is, the resin portion 4 formed inside the groove portions 16 is hooked to the terminal 3.

Successively, a method for manufacturing the electric wire with the terminal 1 will be described based on FIGS. 1(*a*) and 1(*b*).

First, the electric wire 2 is electrically connected to the electric wire connection portion 9 of the terminal 3. Then, the terminal 3 is set in a die (not shown) including an upper die part and a lower die part, and a resin is poured into a cavity in the die. In this manner, the outer circumference ranging from the pair of slope side walls 15*b* to the terminal end portion of the electric wire 2 is completely covered with the resin, as shown in FIGS. 1(*a*) and 1(*b*). That is, the conductor exposure portion in the connection part between the conductor and the terminal 3 is covered with the resin. In addition, the resin flowing into the second connection portion 8*b* also flows into the groove portions 16, as shown in FIG. 1(*b*). That is, the groove portions 16 are filled with the resin. When the resin is solidified, the resin portion 4 is formed. Thus, the electric wire with the terminal 1 in Example 1 as shown in FIG. 1(*a*) is completed.

The resin portion 4 is formed to enter the groove portions 16 of the terminal 3, as shown in FIG. 1(*b*). Thus, the resin portion 4 is hooked to the groove portions 16. When the upper die part in the die is then removed from the lower die part in the direction of the arrow C in FIG. 1(*b*), external force acts on the resin portion 4 in the removing direction of the upper die part (die). Therefore, the resin portion 4 tends to separate from the terminal 3 in the direction of the arrow C. Since the resin portion 4 is hooked to the groove portions 16 here, the groove portions 16 resist against the resin portion 4 which tends to separate from the terminal 3 when the external force acts on the resin portion 4.

As shown in FIG. 1(*a*) to FIG. 3(*b*), each groove portion 16 is formed so that the length of the groove portion 16 in a direction intersecting with the removing direction of the upper die part (die) indicated by the arrow C in FIG. 1(*b*) is longer than the width of the groove portion 16 in the removing direction of the upper die part (die). In this manner, in the groove portion 16, a segment which hooks the resin portion 4 tending to separate from the terminal 3 in the removing direction of the upper die part (die) is wider than in a case where each groove portion is provided to have a length in a removing direction of an upper die part (die) and a width in a direction intersecting with the removing direction of the upper die part (die), the length being longer than the width. Therefore, the groove portion 16 can satisfactorily resist against the resin portion 4 which tends to separate from the terminal 3 in the removing direction of the upper die part (die).

Moreover, for example, in FIG. 1(*a*), the resin portion 4 is hooked to the groove portions 16 even when external force acts on the resin portion 4 from any of various directions as well as when external force acts on the resin portion 4 in an axial direction of the electric wire with the terminal 1 or when external force acts on the resin portion 4 in a direction perpendicular to the axial direction of the electric wire with the terminal 1. Therefore, the groove portions 16 can resist against the resin portion 4 which tends to separate from the terminal 3 when external force acts on the resin portion 4.

As obvious also from the above description, according to the electric wire with the terminal 1 in Example 1, the groove portions 16 serving as separation preventing portions can resist against the resin portion 4 which tends to separate from the terminal 3 when external force acts on the resin portion 4. Consequently, it is possible to provide the electric wire with the terminal 1, in which the resin portion 4 can be prevented from separating from the terminal 3.

Further, according to the electric wire with the terminal 1 in Example 1, the resin portion 4 is hooked to the groove portions 16. Accordingly, the resin portion 4 can be prevented from separating from the terminal 3 even when external force acts on the resin portion 4. In addition, each of the groove portions 16 is provided to have a width in the removing direction of the upper die part (die) and to be longer in the direction intersecting with the removing direction of the upper die part (die) than the width. Accordingly, the groove portions 16 can satisfactorily resist against the resin portion 4 which tends to separate from the terminal 3 in the removing direction of the upper die part (die). Consequently, it is possible to provide the electric wire with the terminal 1, in which the resin portion 4 can be more surely prevented from separating from the terminal 3.

EXAMPLES 2 to 4

Besides the aforementioned Example 1, any of the following Examples 2 to 4 may be used as the electric wire with the terminal according to the invention.

Figure 4:
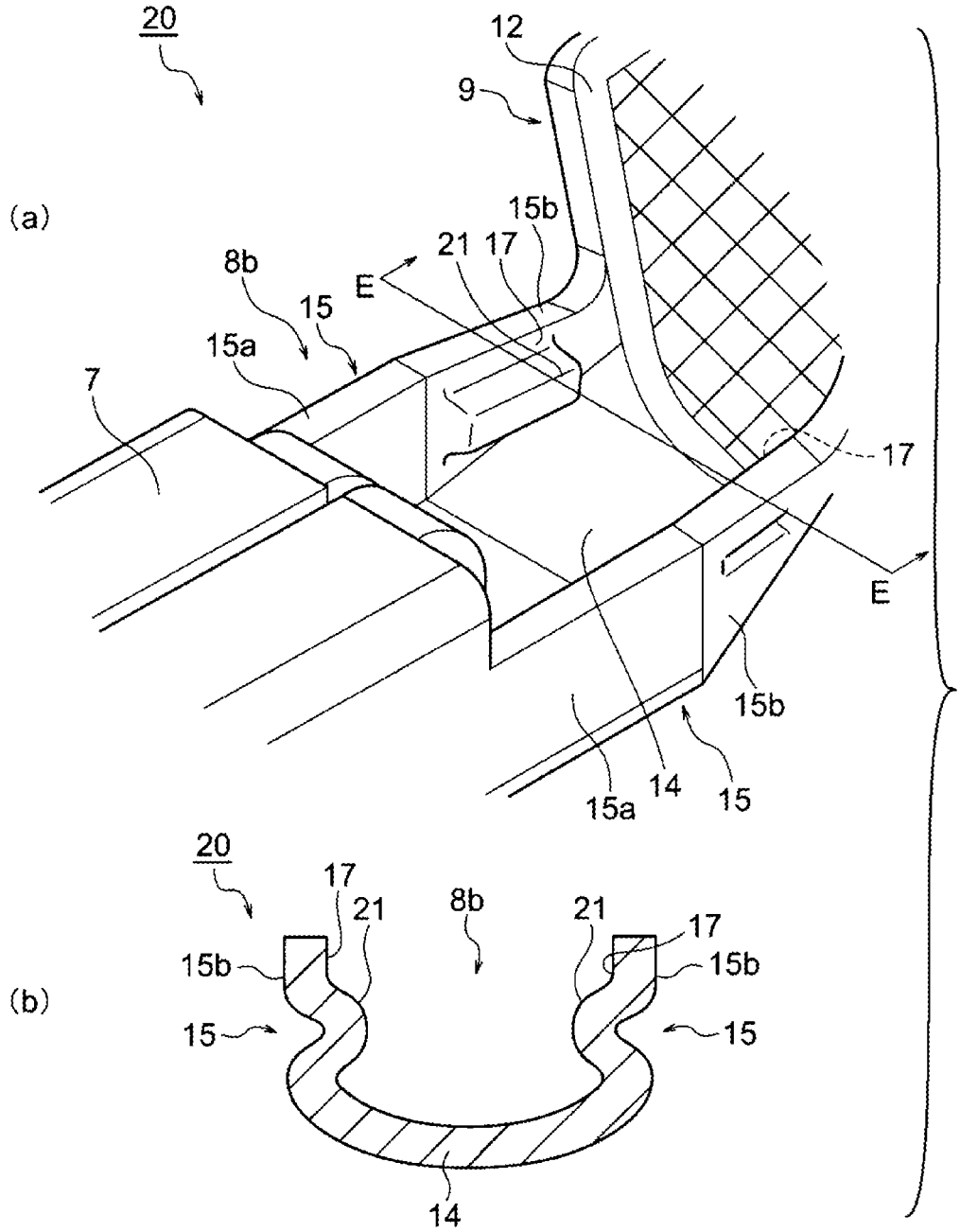
FIG. 4(*a*) is an enlarged perspective view of a terminal in Example 2 of an electric wire with a terminal according to the invention, and FIG. 4(*b*) is a sectional view taken along a line E-E in FIG. 4(*a*).

As shown in FIG. 4(*a*), protrusion portions (separation preventing portions) 21 are provided in a pair of slope side walls 15*b* of a terminal 20 in Example 2. As shown in FIG. 4(*b*), each of the protrusion portions 21 is formed into a convex shape in section. The protrusion portions 21 are formed to protrude from inner faces 17 of the pair of slope side walls 15*b* so as to face each other. Each of the protrusion portions 21 is formed so that the length of the protrusion portion 21 in a direction intersecting a removing direction (the direction of the arrow C in FIG. 1(*b*)) of an upper die part (die) is longer than the width of the protrusion portion 21 in the removing direction of the upper die part (die).

Figure 5:
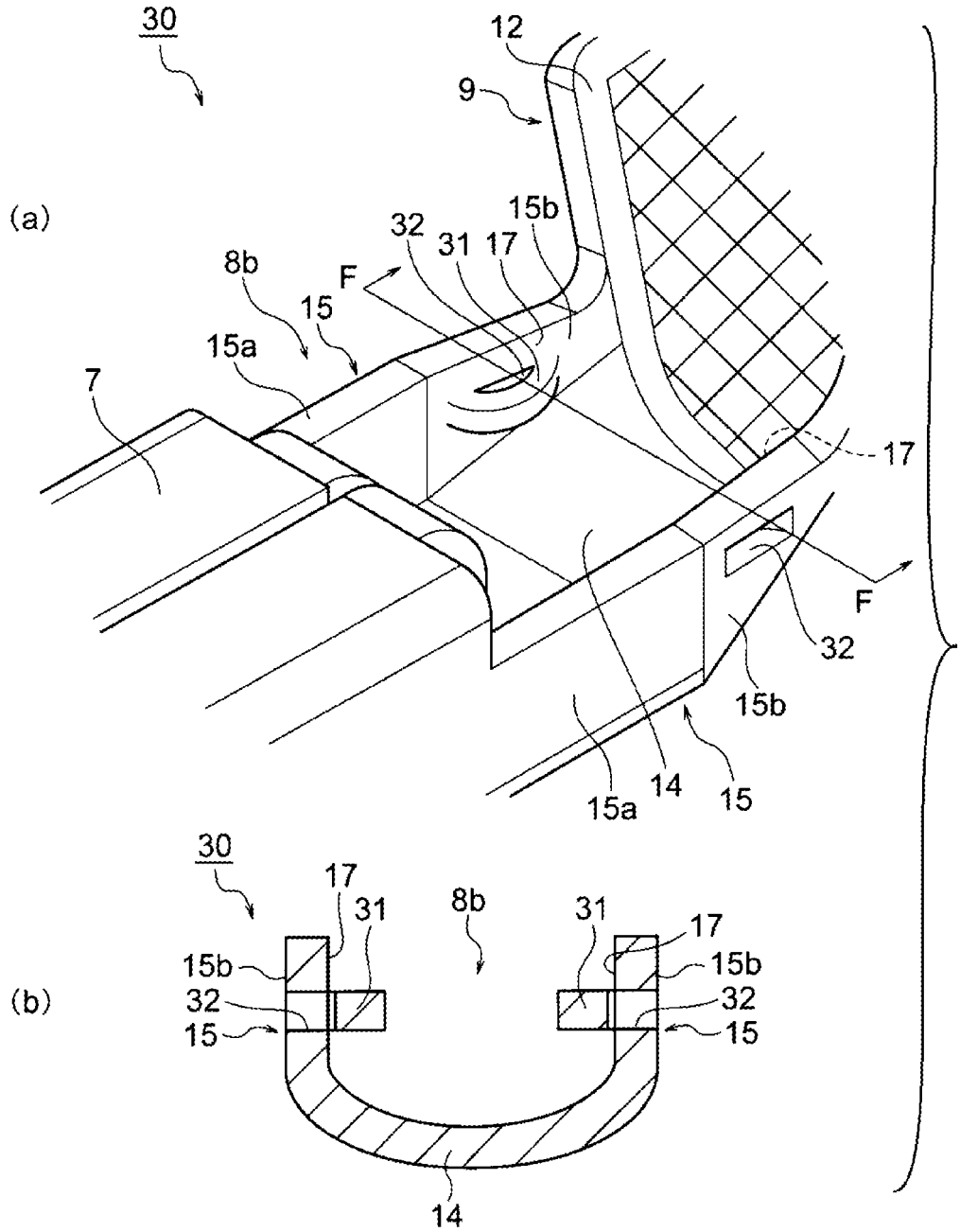
FIG. 5(*a*) is an enlarged perspective view of a terminal in Example 3 of an electric wire with a terminal according to the invention, and FIG. 5(*b*) is a sectional view taken along a line F-F in FIG. 5(*a*).

As shown in FIG. 5, opening portions 32 are bored and formed into a rectangular shape (the shape is not limited to the rectangular shape) in a pair of slope side walls 15*b* of a terminal 30 in Example 3. Protrusion portions (separation preventing portions) 31 are formed at opposite ends of the opening portions 32. Each of the protrusion portions 31 is formed into an arch so as to cover the opening portion 32. The protrusion portions 31 are formed to protrude from inner faces 17 of the slope side walls 15*b* so as to face each other. Each of the protrusion portions 31 is formed so that the length of the protrusion portion 31 in a direction intersecting with a removing direction (the direction of the arrow C in FIG. 1(*b*)) of an upper die part (die) is longer than the width of the protrusion portion 31 in the removing direction of the upper die part (die).

Figure 6:
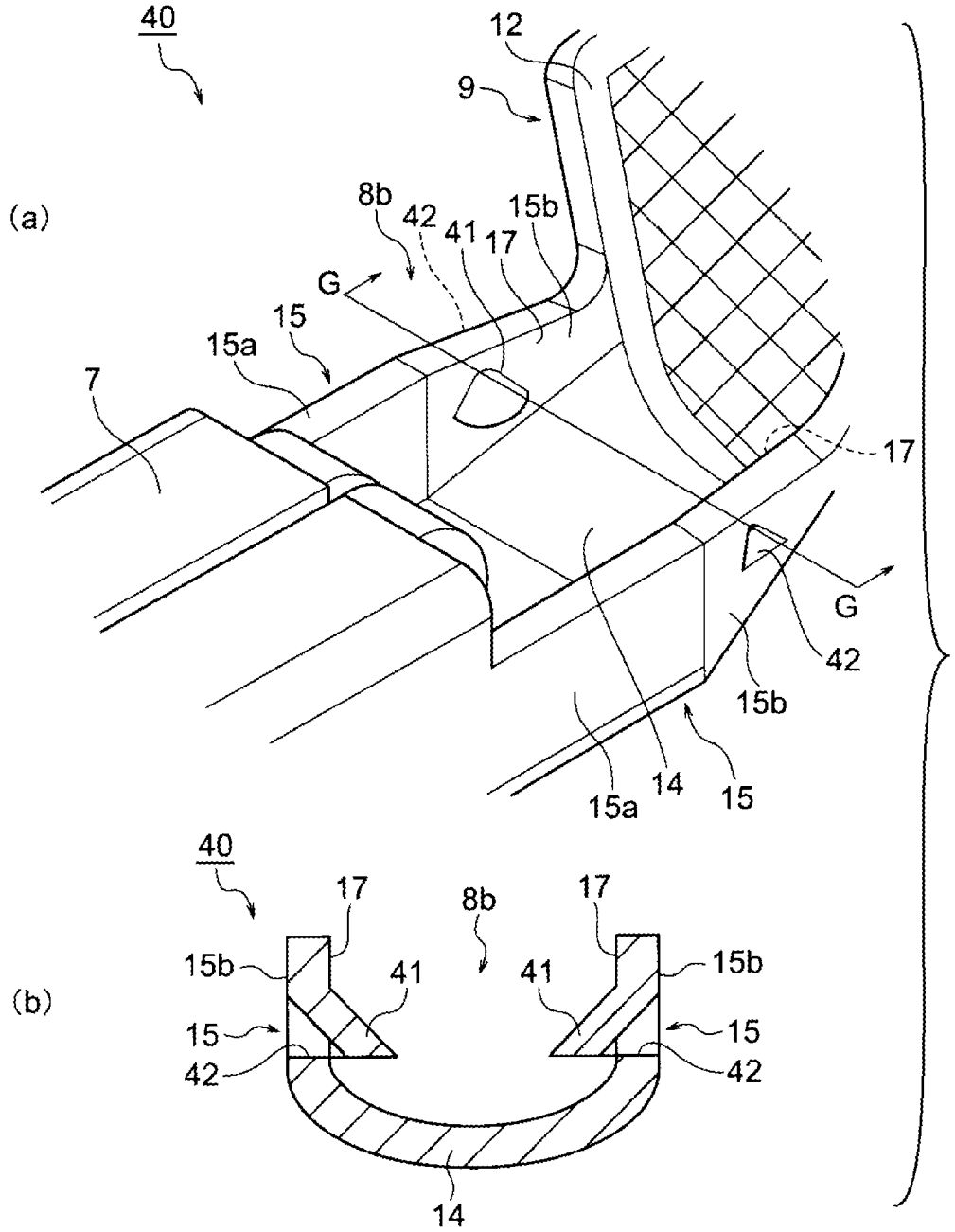
FIG. 6(*a*) is an enlarged perspective view of a terminal in Example 4 of an electric wire with a terminal according to the invention, and FIG. 6(*b*) is a sectional view taken along a line G-G in FIG. 6(*a*).

As shown in FIG. 6, opening portions 42 are bored and formed into a triangular shape (the shape is not limited to the triangular shape) in a pair of slope side walls 15*b* of a terminal 40 in Example 4. Protrusion portions (separation preventing portions) 41 are formed at one ends of the opening portions 42. Each of the protrusion portions 41 is formed substantially into a fan shape so as to cover the opening portion 42. The protrusion portions 41 are formed to protrude from inner faces 17 of the slope side walls 15*b* so as to face each other. Each of the protrusion portions 41 is formed so that the length of the protrusion portion 41 in a direction intersecting with a removing direction (the direction of the arrow C in FIG. 1(*b*)) of an upper die part (die) is longer than the width of the protrusion portion 41 in the removing direction of the upper die part (die).

According to such a terminal 20 in Example 2, a resin portion 4 is formed as if the protrusion portions 21 were put between parts of the resin portion 4. In addition, according to the terminal 30, 40 in Example 3, 4, a resin enters the opening portions 32, 42 when a resin portion 4 is formed. Thus, the resin portion 4 is formed inside the opening portions 32, 42. In this manner, the protrusion portions 31, 41 lock the resin portion 4. With this arrangement, the resin portion 4 is hooked to the protrusion portions 21, 31, 41 when the resin portion 4 is formed. In this manner, the resin portion 4 can be prevented from separating from the terminal 20, 30, 40 even when external force acts on the resin portion 4. In addition, each of the protrusion portions 21, 31, 41 is provided to have a width in the removing direction of the upper die part (die) and to be longer in the direction intersecting with the removing direction of the upper die part (die) than the width. In this manner, in the protrusion portion 21, 31, 41, a segment which hooks the resin portion 4 tending to separate in the removing direction of the upper die part (die) is wider than in a case where each protrusion portion is provided to have a length in a removing direction of an upper die part (die) and a width in a direction intersecting with the removing direction of the upper die part (die), the length being longer than the width. Accordingly, the protrusion portion 21, 31, 41 can satisfactorily resist against the resin portion 4 which tends to separate in the removing direction of the upper die part (die).

As obvious also from the above description, according to the electric wire with the terminal in each of Examples 2 to 4, it is possible to obtain a similar effect to that of the electric wire with the terminal 1 in Example 1. In addition thereto, since particularly the resin portion 4 is hooked to the protrusion portions 21, 31, 41, the resin portion 4 can be prevented from separating from the terminal 20, 30, 40 even when external force acts on the resin portion 4. Moreover, each of the protrusion portions 21, 31, 41 is provided to have a width in the removing direction of the upper die part (die) and to be longer in the direction intersecting with the removing direction of the upper die part (die) than the width. Accordingly, the protrusion portions 21, 31, 41 can satisfactorily resist against the resin portion 4 which tends to separate in the removing direction of the upper die part (die). Consequently, it is possible to provide the electric wire with the terminal, in which the resin portion 4 can be more surely prevented from separating from the terminal 20, 30, 40.

EXAMPLE 5

Besides the aforementioned Examples 1 through 4, the following Example 5 may be used as the electric wire with the terminal according to the invention.

Figure 7:
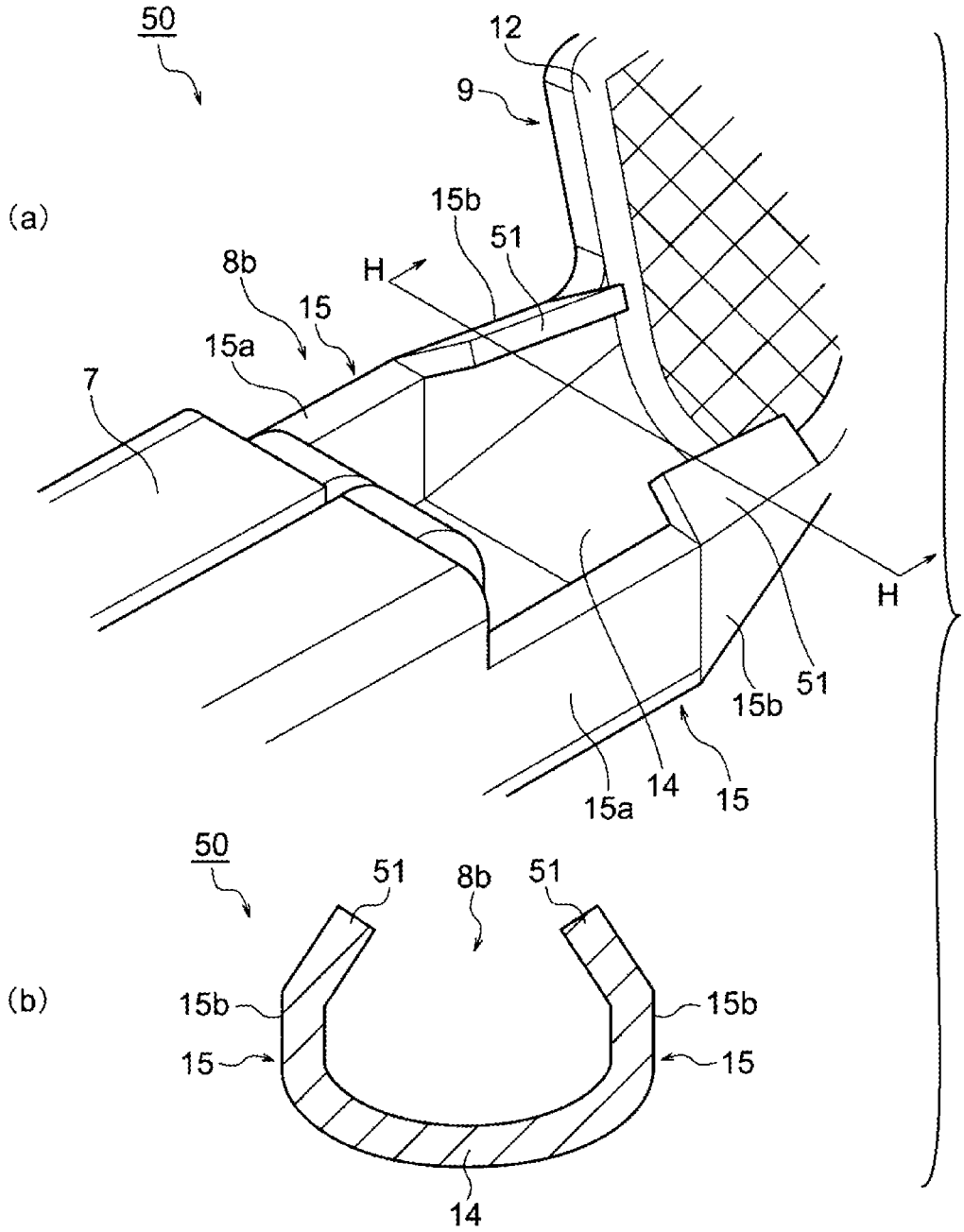
FIG. 7(*a*) is an enlarged perspective view of a terminal in Example 5 of an electric wire with a terminal according to the invention, and FIG. 7(*b*) is a sectional view taken along a line H-H in FIG. 7(*a*).

As shown in FIG. 7, front ends of a pair of slope side walls 15*b* of a terminal 50 in Example 5 are formed to protrude with a predetermined length from front ends of a pair of parallel side walls 15*a*. The front ends of the pair of slope side walls 15*b* are bent inward to be formed as bent portions (separation preventing portions) 51. Each of the bent portions 51 is formed so that the length of the bent portion 51 in a longitudinal direction of the terminal 50 is longer than the width of the bent portion 51 in a direction perpendicular to the longitudinal direction of the terminal 50 (when the bent portion 51 is formed thus, a segment of the bent portion 51 which hooks the resin portion 4 in FIGS. 1(*a*) and 1(*b*) can be made larger).

According to such a terminal 50 in Example 5, the resin portion 4 is also formed on lower sides of the bent portions 51 when the resin portion 4 is formed. In this manner, the resin portion 4 is hooked to the bent portions 51. Accordingly, the resin portion 4 can be prevented from separating from the terminal 50 even when external force acts on the resin portion 4. In addition, the bent portions 51 are provided as if the bent portions 51 covered the resin portion 4 formed inside the terminal 50. In this manner, the bent portions 51 serve as portions to which the resin portion 4 tending to separate from the terminal 50 in the removing direction of the upper die part (die) is hooked. Accordingly, the bent portions 51 can satisfactorily resist against the resin portion 4 which tends to separate from the terminal 50 in the removing direction of the upper die part (die).

As obvious also from the above description, according to the terminal 50 in Example 5, it is possible to obtain a similar effect to that of the terminal 3 in Example 1. In addition thereto, since particularly the resin portion 4 is hooked to the bent portions 51, the resin portion 4 can be prevented from separating from the terminal 50 even when external force acts on the resin portion 4. Moreover, the bent portions 51 are provided as if the bent portions 51 covered the resin portion 4 present inside the terminal 50. Accordingly, the bent portions 51 can satisfactorily resist against the resin portion 4 which tends to separate in the removing direction of the upper die part (die). Consequently, it is possible to provide the electric wire with the terminal, in which the resin portion 4 can be more surely prevented from separating from the terminal 50.

EXAMPLE 6

Besides the aforementioned Examples 1 through 5, the following Example 6 may be used as the electric wire with the terminal according to the invention.

Figure 8:
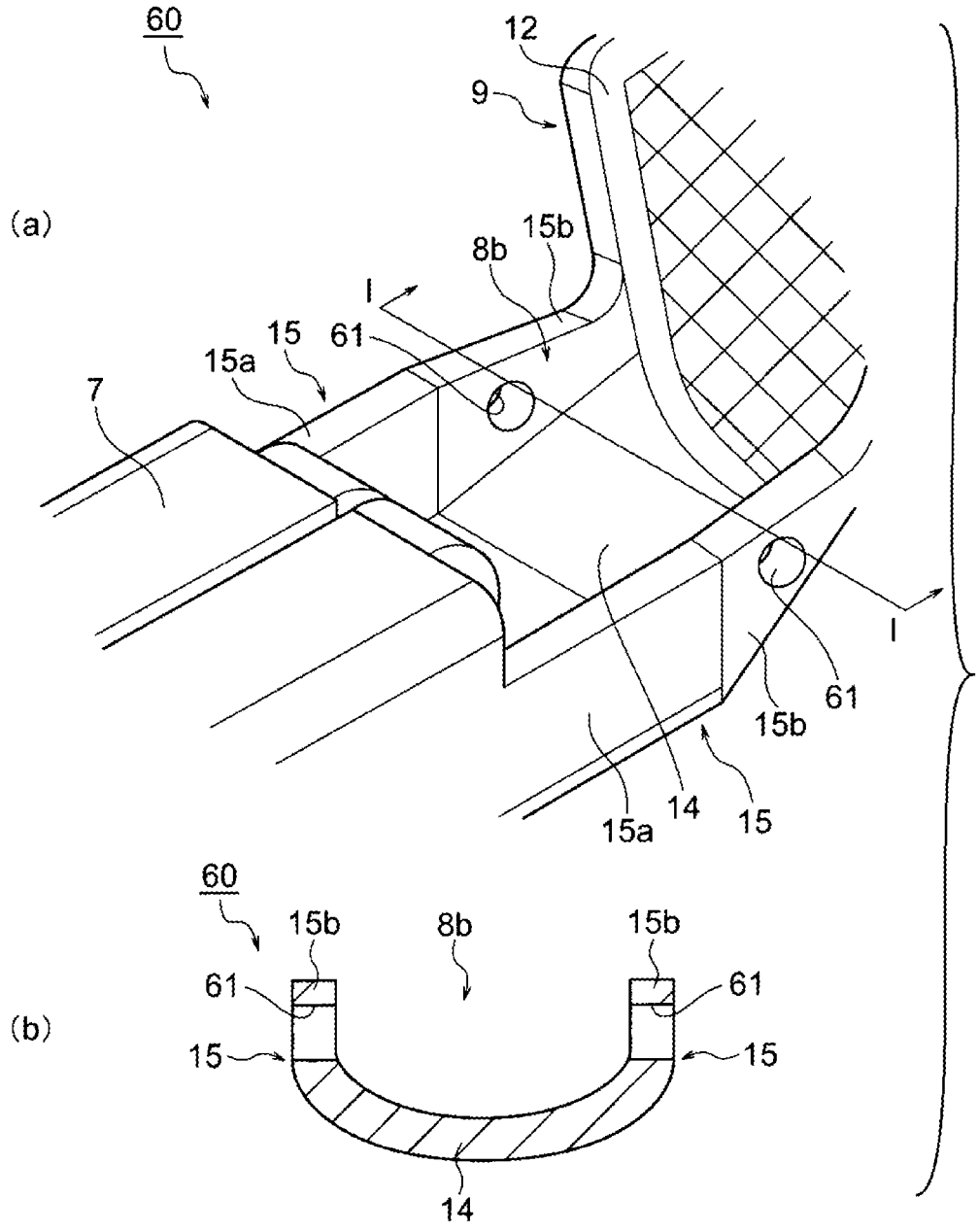
FIG. 8(*a*) is an enlarged perspective view of a terminal in Example 6 of an electric wire with a terminal according to the invention, and FIG. 8(*b*) is a sectional view taken along a line I-I in FIG. 8(*a*).

As shown in FIG. 8, opening portions (separation preventing portion) 61 are bored and formed in a pair of slope side walls 15*b* of a terminal 60 in Example 6. Each of the opening portions 61 is formed into a perfectly circular shape. Alternatively, the opening portion 61 may be formed into an oval shape (the shape is simply an example). In addition, although not shown, the opening portion 61 is not limited to the circular shape but may be formed into a polygonal shape such as a triangular shape, a square shape, a rectangular shape, etc. Incidentally, in the case of the opening portion 61 formed into an oval shape, a rectangular shape etc. which has longer sides, the opening portion 61 is formed so that the length of the opening portion 61 in a direction (the direction of the arrow C in FIG. 1(*b*)) intersecting with a removing direction of an upper die part (die) is longer than the width of the opening portion 61 in the removing direction of the upper die part (die).

According to such a terminal 60 in Example 6, a resin enters the opening portions 61 when a resin portion 4 is formed. Thus, the resin portion 4 is formed inside the opening portions 61. In this manner, the resin portion 4 is hooked to the opening portions 61. Accordingly, the resin portion 4 can be prevented from separating from the terminal 60 even when external force acts on the resin portion 4. In addition, the opening portions 61 are provided in the slope side walls 15*b* provided erectly in the removing direction of the upper die part (die). Accordingly, the opening portions 61 can satisfactorily resist against the resin portion 4 which tends to separate from the terminal 60 in the removing direction of the upper die part (die).

In addition, according to the terminal 60 in Example 6, the separation preventing portions can be provided by just boring and forming the opening portions 61 in the slope side walls 15*b*.

As obvious also from the above description, according to the terminal 60 in Example 6, it is possible to obtain a similar effect to that of the terminal 3 in Example 1. In addition thereto, since particularly the resin portion 4 is hooked to the opening portions 61, the resin portion 4 can be prevented from separating from the terminal 60 even when external force acts on the resin portion 4. Moreover, the opening portions 61 are provided in the slope side walls 15*b* provided erectly in the removing direction of the upper die part (die). Accordingly, the opening portions 61 can satisfactorily resist against the resin portion 4 which tends to separate from the terminal 60 in the removing direction of the upper die part (die). Consequently, it is possible to provide the electric wire with the terminal, in which the resin portion 4 can be more surely prevented from separating from the terminal 60.

In addition, according to the terminal 60 in Example 6, the separation preventing portions can be provided by just boring and forming the opening portions 61 in the slope side walls 15*b*. Accordingly, the separation preventing portions can be provided easily, in addition to the aforementioned effect.

EXAMPLE 7

Besides the aforementioned Examples 1 through 6, the following Example 7 may be used as the electric wire with the terminal according to the invention.

Figure 9:
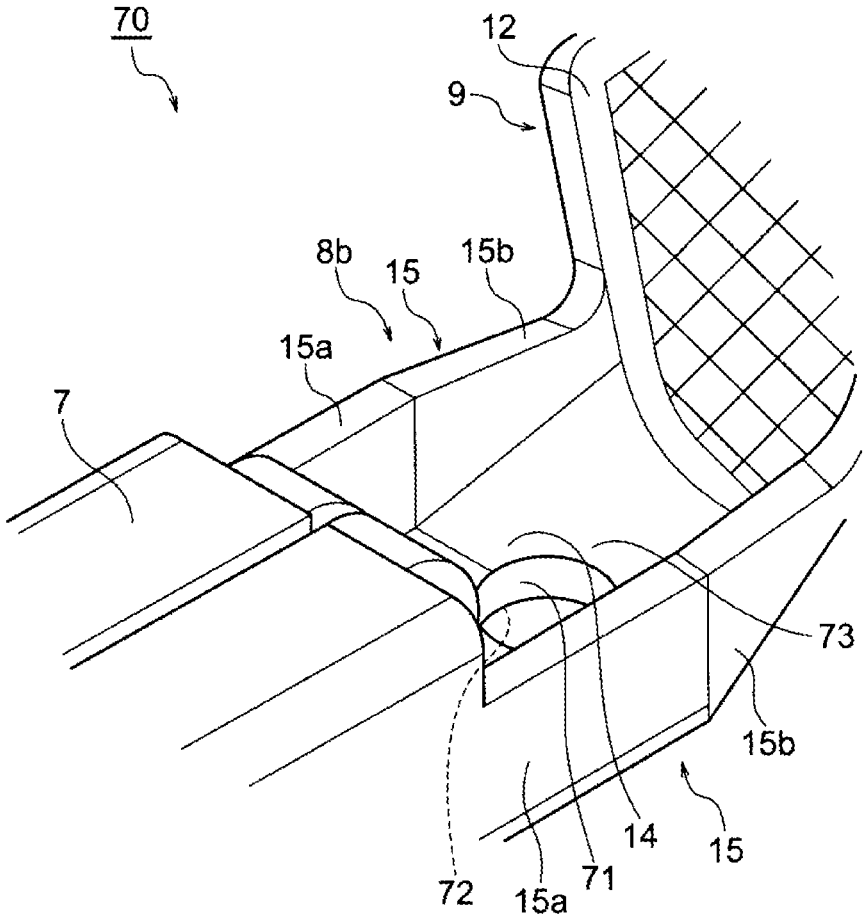
FIG. 9 is an enlarged perspective view of a terminal in Example 7 of an electric wire with a terminal according to the invention.
Figure 11:
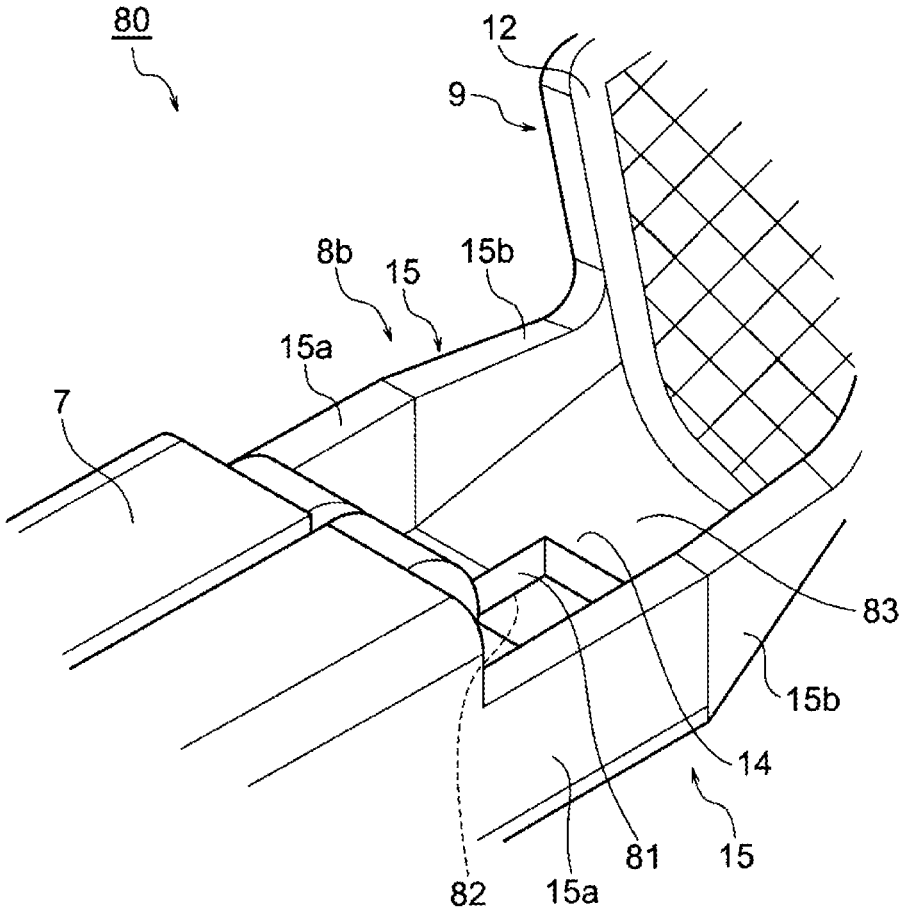
FIG. 11 is an enlarged perspective view showing a modification of the terminal in Example 7 of the electric wire with the terminal according to the invention.

As shown in FIG. 9, an opening portion (separation preventing portion) 71 is bored and formed in a substantially central portion of a bottom wall 14 of a terminal 70 in Example 7. Incidentally, although the opening portion 71 is formed into a perfectly circular shape, the opening portion 71 may be formed into a quadrangular shape like an opening portion (separation preventing portion) 81 bored and formed in a bottom wall 14 of a terminal 80 in FIG. 11 (the opening portion 71 is not limited to any of these shapes. Alternatively, for example, the opening portion 71 may be formed into another polygonal shape such as a triangular shape).

Figure 12:
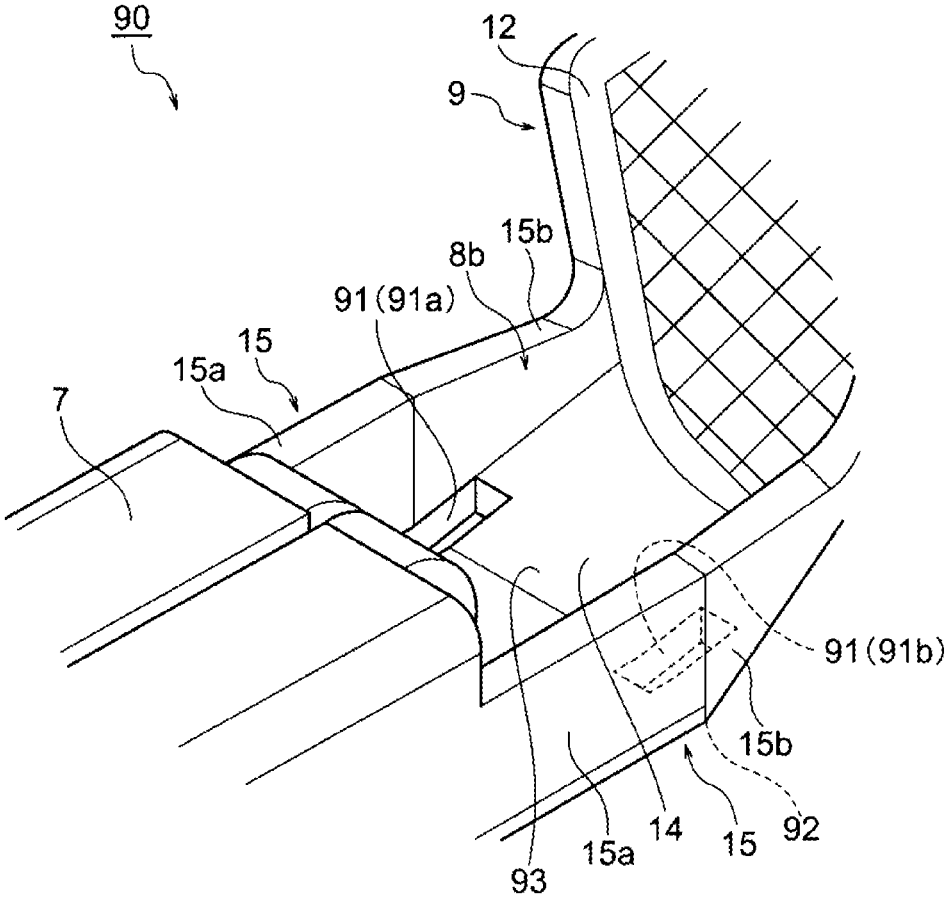
FIG. 12 is an enlarged perspective view showing another modification of the terminal in Example 7 of the electric wire with the terminal according to the invention.

In addition, the opening portion 71 may be formed in the vicinity of a place where the bottom wall 14 and each side wall 15 are continued to each other, like an opening portion (separation preventing portion) 91 bored and formed in a bottom wall 14 of a terminal 90 in FIG. 12. Incidentally, an opening portion 91*b* is bored and formed in the vicinity of a place where the bottom wall 14 is continued to a side wall 15 on an opposite side to a location where an opening portion 90*a* is formed, as shown in FIG. 12. Each opening portion 91 is formed into a rectangular shape (the shape is not limited to the rectangular shape. Alternatively, for example, the shape may be an oval shape).

Here, an effect which can be achieved by Example 7 will be described based on FIG. 10.

Figure 10:
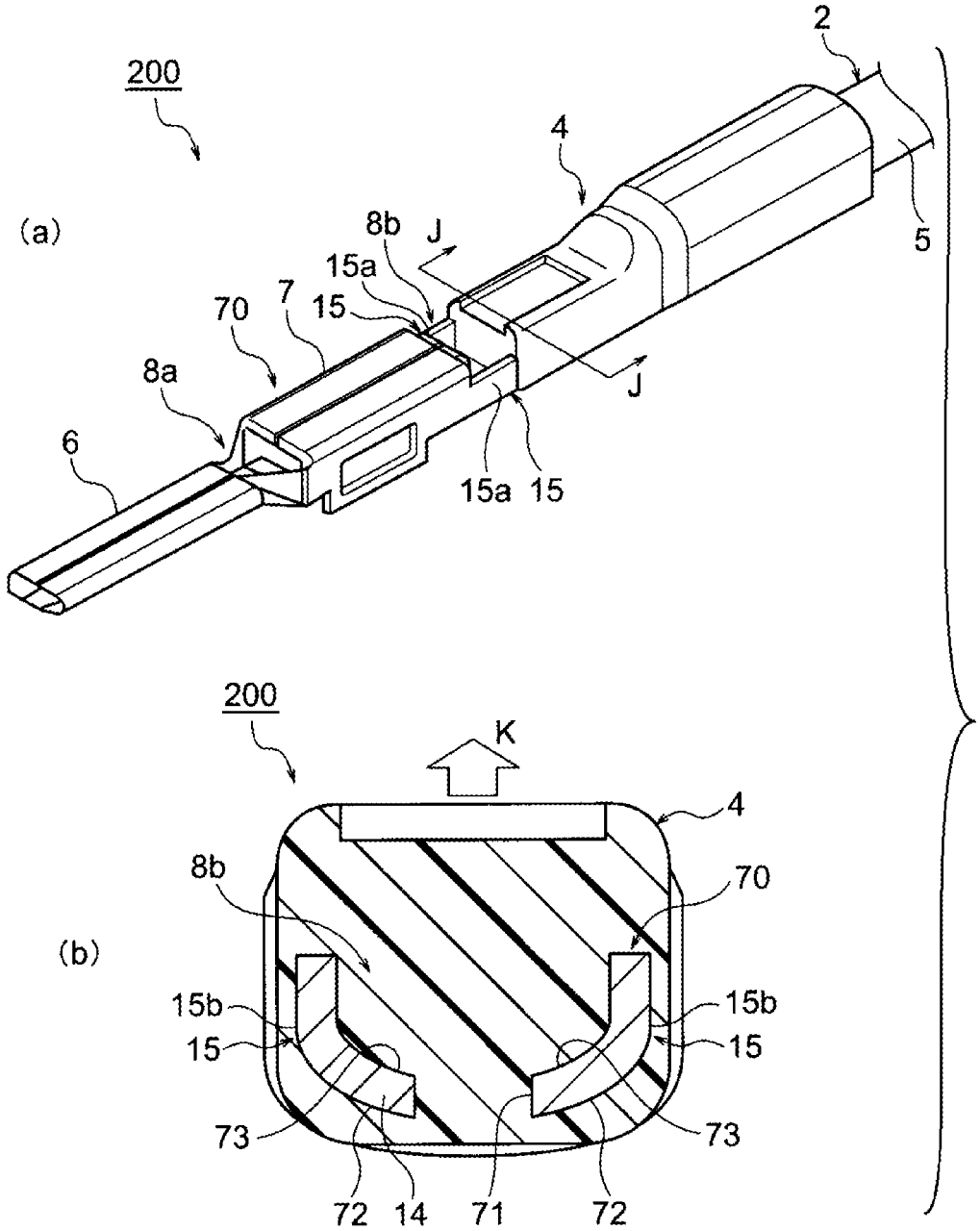
FIG. 10(*a*) is a perspective view showing Example 7 of an electric wire with a terminal according to the invention, and FIG. 10(*b*) is a sectional view taken along a line J-J in FIG. 10(*a*).

As shown in FIG. 10(*a*), an electric wire with a terminal 200 is provided with a terminal 70 in FIG. 9. Except that, the electric wire with the terminal 200 has the remaining configuration the same as that of the electric wire with the terminal 1 in FIG. 1. Accordingly, description about the remaining configuration will be omitted. Incidentally, although the electric wire with the terminal 200 provided with the terminal 70 will be described here, an electric wire with a terminal provided with a terminal 80 in FIG. 11 or a terminal 90 in FIG. 12 may be used alternatively.

When a resin portion 4 is molded by a die as shown in FIG. 10(*a*), the resin portion 4 is formed to forcibly enter the opening portion 71 and formed to also cover an outer face 72 of a bottom wall 14, as shown in FIG. 10(*b*). Incidentally, although not shown, it will go well as long as the resin portion 4 partially covers the inside of the opening portion 71. That is, the resin portion 4 may be formed not to entirely cover the inside of the opening portion 71. The resin portion 4 covers an inner face 73 of the bottom wall 14. In addition, the resin portion 4 is formed to forcibly enter the opening portion 71 to thereby further cover the outer face 72 of the bottom wall 14. With this arrangement, the resin portion 4 is formed as if the bottom wall 14 were put between the resin portion 4 covering the inner face 73 of the bottom wall 14 and the resin portion 4 covering the outer face 72 of the bottom wall 14. That is, the resin portion 4 is hooked to the bottom wall 14.

When an upper die part (die) is removed in a direction of an arrow K in FIG. 10(*b*) after the resin portion 4 is molded by the die, external force acts on the resin portion 4 in the removing direction of the upper die part (die). Therefore, the resin portion 4 tends to separate from the terminal 70 in the direction of the arrow K. Here, the resin portion 4 is formed so that the bottom wall 14 of the terminal 70 can be put between parts of the resin portion 4. In this manner, the resin portion 4 is hooked to the bottom wall 14. Accordingly, since the resin portion 4 is hooked to the bottom wall 14, the resin portion 4 can be prevented from separating from the terminal 70 even when external force acts on the resin portion 4. In addition, the resin portion 4 is hooked to the bottom wall 14 so that separation of the resin portion 4 can be prevented. Accordingly, it is not necessary to entirely cover the inside of the opening portion 71 with the resin portion 4.

As obvious also from the above description, according to the terminal 70 (80, 90) in Example 7, the resin portion 4 covers the inner face 73 (83, 93) of the bottom wall 14, and forcibly enters the opening portion 71 (81, 91) to cover the outer face (72) of the bottom wall 14. Therefore, the resin portion 4 is formed as if the bottom wall 14 were put between the resin portion 4 covering the inner face 73 (83, 93) of the bottom wall 14 and the resin portion 4 covering the outer face 72 (82, 92) of the bottom wall 14. In this manner, the resin portion 4 is hooked to the bottom wall 14. With this arrangement, the resin portion 4 can be prevented from separating from the terminal 70 (80, 90) even when external force acts on the resin portion 4. Consequently, it is possible to provide the electric wire with the terminal 200, in which the resin portion 4 can be more surely prevented from separating from the terminal 70 (80, 90).

In addition, according to the terminal 70 (80, 90) in Example 7, the separation preventing portion can be provided by just boring and forming each opening portion 71 (81, 91) in the bottom wall 14. Accordingly, the separation preventing portion can be provided easily, in addition to the aforementioned effect.

EXAMPLE 8

Besides the aforementioned Examples 1 through 7, the following Example 8 may be used as the electric wire with the terminal according to the invention.

Figure 13:
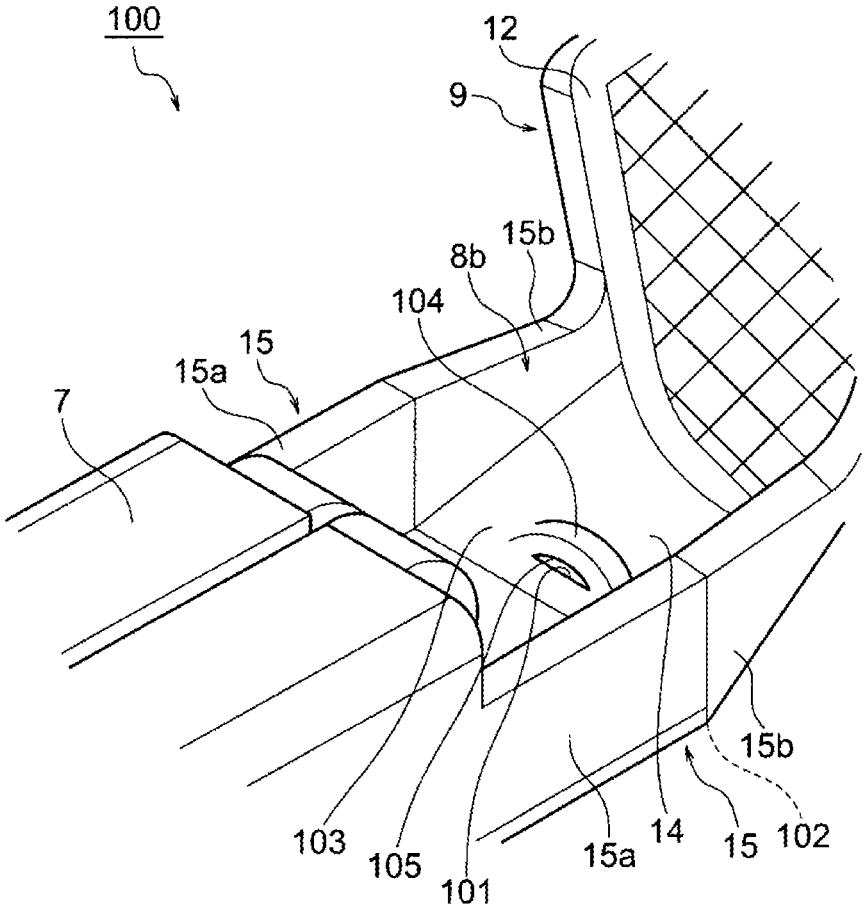
FIG. 13 is an enlarged perspective view of a terminal in Example 8 of an electric wire with a terminal according to the invention.

As shown in FIG. 13, an opening portion (separation preventing portion) 101 is bored and formed in a substantially central portion of a bottom wall 14 of a terminal 100 in Example 8. The opening portion 101 is formed into a rectangular shape (the shape is not limited to the rectangular shape) perpendicularly to a longitudinal direction of the terminal 100. A lock portion 104 is provided in the bottom wall 14 perpendicularly to the longitudinal direction of the terminal 100 to thereby cover an upper face of the opening portion 101. The lock portion 104 is formed to protrude from an inner face 103 of the bottom wall 14. The lock portion 104 is formed into an arch having a substantially circular arc shape so as to be joined to opposite ends of the opening portion 101 (the shape is simply an example. Alternatively, the lock portion 104 may be formed into another arch having another shape than the substantially circular arc shape as will be described later). A hole portion 105 is formed between the upper face of the opening portion 101 and a lower side of the lock portion 104. The hole portion 105 communicates with the opening portion 101.

Figure 14:
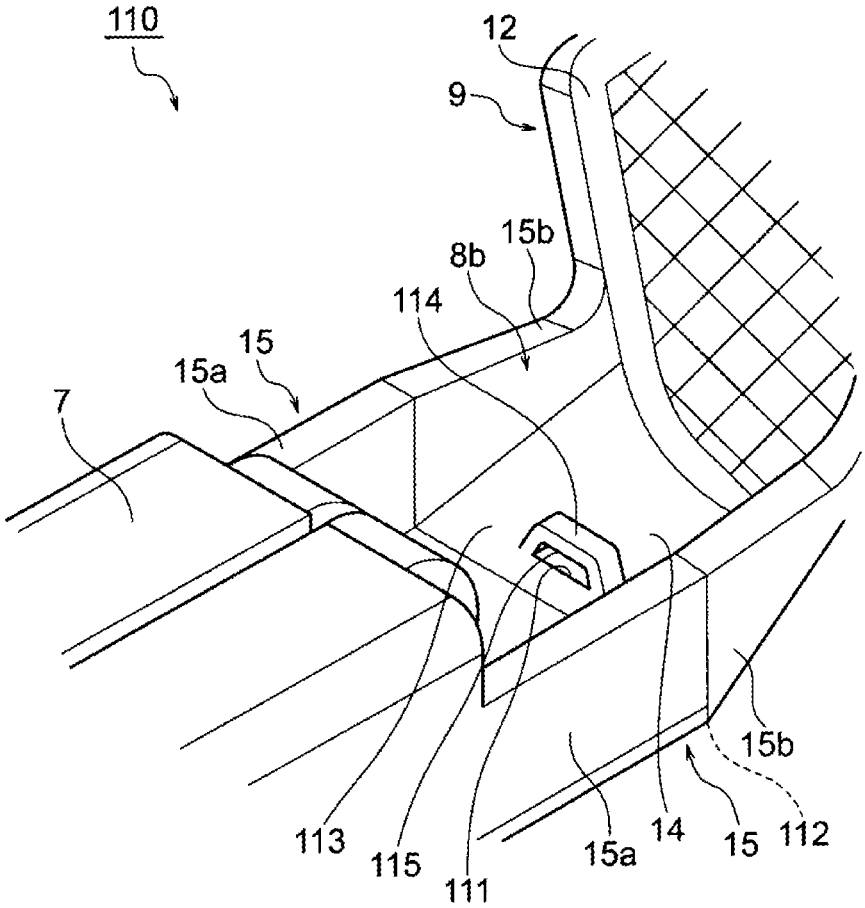
FIG. 14 is an enlarged perspective view showing a modification of the terminal in Example 8 of the electric wire with the terminal according to the invention.

In addition, as in a terminal 110 in FIG. 14, a lock portion 114 may be formed to protrude from an inner face 113 of a bottom wall 14, and formed into an arch having a substantially square bracket shape so as to be joined to opposite ends of an opening portion (separation preventing portion) 111. A hole portion 115 is formed between an upper face of the opening portion 111 and a lower side of the lock portion 114.

According to such a terminal 100, 110 in Example 8, a resin enters from the hole portion 105, 115 and goes into the opening portion 101, 111, when a resin portion 4 is formed. In this manner, the resin portion 4 is formed inside the opening portion 101, 111. Thus, the lock portion 104, 114 formed to cover the upper face of the opening portion 101, 111 locks the resin portion 4. That is, as in the aforementioned Example 7, the resin portion 4 is hooked to the bottom wall 14 even without covering an outer face 102, 112 of the bottom wall 14. Accordingly, the lock portion 104, 114 locks the resin portion 4 even when external force acts on the resin portion 4. Accordingly, the resin portion 4 can be prevented from separating from the terminal 100, 110.

As obvious also from the above description, according to the terminal 100, 110 in Example 8, when the resin portion 4 is formed inside the opening portion 101, 111, the lock portion 104, 114 locks the resin portion 4. Thus, the resin portion 4 can be prevented from separating from the terminal 100, 110 even when external force acts on the resin portion 4. Consequently, it is possible to provide the electric wire with the terminal, in which the resin portion 4 can be more surely prevented from separating from the terminal 100, 110.

EXAMPLE 9

Besides the aforementioned Examples 1 through 8, the following Example 9 may be used as the electric wire with the terminal according to the invention.

Figure 15:
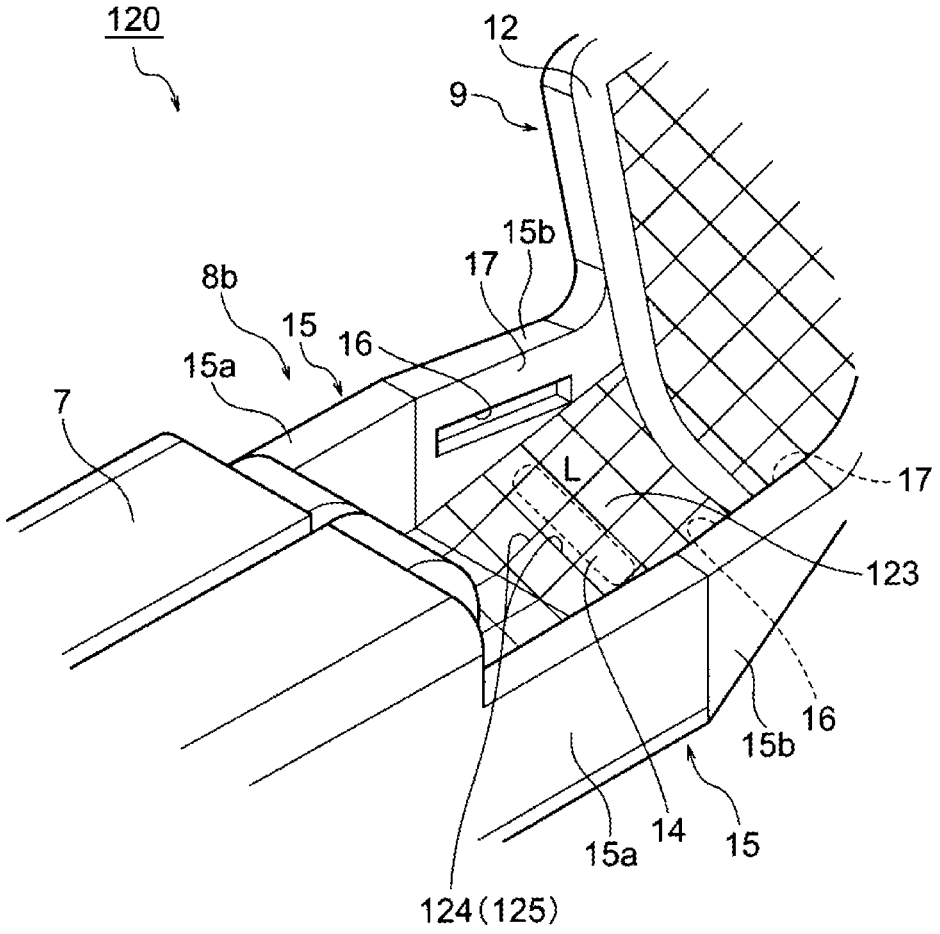
FIG. 15 is an enlarged perspective view of a terminal in Example 9 of an electric wire with a terminal according to the invention.

As shown in FIG. 15, a terminal 120 has the same configuration as the terminal 3 in FIG. 3, except that convex portions 124 or concave portions 125 are formed in an inner face 123 of a bottom wall 14. The convex portions 124 or the concave portions 125 are formed into a grid pattern in the inner face of the bottom wall 14.

Figure 16:
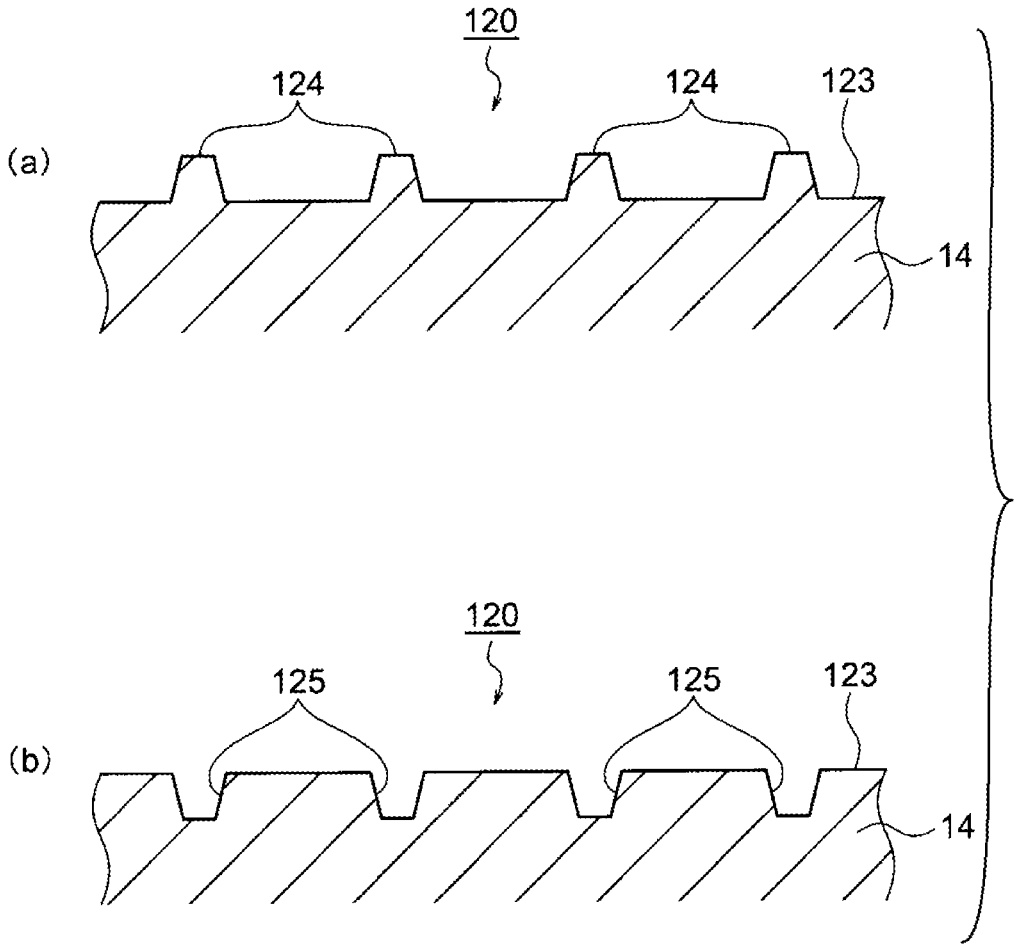
FIG. 16(*a*) is a partial sectional view of the terminal when convex portions are provided in a bottom wall in FIG. 15, and FIG. 16(*b*) is a partial sectional view of the terminal when concave portions are provided in a bottom wall in FIG. 15.

FIGS. 16(*a*) and 16(*b*) are partial sectional views of a portion encircled by a broken line L in FIG. 15. FIG. 16(*a*) shows the case where the convex portions 124 are formed in the inner face 123 of the bottom wall 14. The convex portions 124 are formed at predetermined intervals in the inner face 123 of the bottom wall 14. The convex portions 124 are provided to be convex upwards in section. FIG. 16(*b*) shows the case where the concave portions 125 are formed in the inner face 123 of the bottom wall 14. The concave portions 125 are formed at predetermined intervals in the inner face 123 of the bottom wall 14. Each of the concave portions 125 is formed as a groove portion shaped like a substantially square bracket in section (the shape is not limited thereto. Alternatively, for example, the concave portion 125 may be formed substantially into a U shape in section).

As shown in FIG. 15, protrusion portions 21 in FIG. 4 may be provided in place of the groove portions 16 in inner faces 17 of a pair of slope side walls 15*b* of a terminal 120. In addition, protrusion portions 31 in FIG. 5 may be provided alternatively. Further, protrusion portions 41 in FIG. 6 may be provided alternatively. In addition thereto, front ends of the pair of slope side walls 15*b* may be bent inward so that bent portions 51 can be formed alternatively, as shown in FIG. 7. In addition, opening portions 61 may be bored and formed in the pair of slope side walls 15*b* alternatively, as shown in FIG. 8.

According to such a terminal 120 in Example 9, a resin portion 4 covers the inner face 123 of the bottom wall 14 where the convex portions 124 or the concave portions 125 are formed. Thus, an area of the bottom wall 14 in close contact with the resin portion 4 increases. In this manner, the resin portion 4 is hooked to the groove portions 16 or the protrusion portions 21, 31, 41 (otherwise, the bent portions 51 or the opening portions 61) and the area of the bottom wall 14 in close contact with the resin portion 4 increases. Accordingly, close contact force of the resin portion 4 to the terminal 120 is improved. Consequently, it is possible to satisfactorily suppressing the resin portion 4 from separating from the terminal 120 even when external force acts on the resin portion 4.

As obvious also from the above description, according to the terminal 120 in Example 9, the area of the bottom wall 14 in close contact with the resin portion 4 increases. Thus, the close contact force of the resin portion 4 to the terminal 120 is improved so that it is possible to satisfactorily suppress the resin portion 4 from separating from the terminal 120 even when external force acts on the resin portion 4. Consequently, it is possible to provide the electric wire with the terminal, in which the resin portion 4 can be more surely prevented from separating from the terminal 120.

Here, the aforementioned characteristics of the embodiments of the electric wire with the terminal according to the invention will be briefly summarized and stated in the following paragraphs [1] to [8] respectively.

[1] An electric wire with a terminal (1, 200), in which a resin portion (4) molded by a die covers a conductor exposure portion of a terminal (3, 20, 30, 40, 50, 60, 70, 80, 90, 100, 110, 120) to which a conductor is connected, wherein:

at least a separation preventing portion (each groove portion 16, each protrusion portion 21, 31, 41, each bent portion 51, each opening portion 61, 71, 81, 91, 101, 111) is provided at a part of the terminal (3, 20, 30, 40, 50, 60, 70, 80, 90, 100, 110, 120) covered with the resin portion (4) so that the separation preventing portion (the groove portion 16, the protrusion portion 21, 31, 41, the bent portion 51, the opening portion 61, 71, 81, 91, 101, 111) prevents the resin portion (4) from separating from the terminal (3, 20, 30, 40, 50, 60, 70, 80, 90, 100, 110, 120) in a removing direction of the die after the resin portion (4) is molded by the die.

[2] The electric wire with the terminal (1, 200) according to the aforementioned paragraph [1], wherein the separation preventing portion (the groove portion 16, the protrusion portion 21, 31, 41, the bent portion 51, the opening portion 61, 71, 81, 91, 101, 111) is provided in a side wall (15) or a bottom wall (14) of the terminal (3, 20, 30, 40, 50, 60, 70, 80, 90, 100, 110, 120) at the part covered with the resin portion (4).

[3] The electric wire with the terminal (1) according to the aforementioned paragraph [2], wherein the separation preventing portion (the groove portion 16, the protrusion portion 21, 31, 41) serves as a groove portion (16) or a protrusion portion (21, 31, 41) which is formed to have a width in the removing direction of the die and to be longer in a direction intersecting with the removing direction of the die than the width.

[4] The electric wire with the terminal (1) according to the aforementioned paragraph [2], wherein the separation preventing portion (51) includes a bent portion (51) which is formed by bending a front end of the side wall (15) inward.

[5] The electric wire with the terminal (1, 200) according to the aforementioned paragraph [2], wherein the separation preventing portion (61, 71, 81, 91) has an opening portion (61, 71, 81, 91) which is bored and formed in the side wall (15).

[6] The electric wire with the terminal (200) according to the aforementioned paragraph [2], wherein the separation preventing portion (71, 81, 91, 101, 111) has an opening portion (71, 81, 91, 101, 111) which is bored and formed in the bottom wall (14), and wherein the resin portion (4) is formed so as to enter the opening portion (71, 81, 91, 101, 111), and formed to cover an outer face (72, 82, 92, 102, 112) of the bottom wall (14).

[7] The electric wire with the terminal (200) according to the aforementioned paragraph [6], wherein a lock portion (104, 114) is formed into an arch shape so as to be joined to opposite ends of the opening portion (101, 111).

[8] The electric wire with the terminal (200) according to any one of the aforementioned paragraphs [3], [4] and [5], wherein convex portions (124) or concave portions (125) are formed into a grid pattern in the bottom wall (14).

In addition thereto, it is a matter of course that the invention can be carried out with various changes made thereon without changing the gist of invention.

Moreover, the present application is based on a Japanese patent application (Patent Application No. 2013-234727) which was filed on Nov. 13, 2013 and the contents of which are incorporated herein by reference.

INDUSTRIAL APPLICABILITY

According to the electric wire with the terminal according to the invention, it is possible to prevent the resin portion from separating from the terminal when external force acts on the resin portion. Particularly, it is useful for preventing the resin portion from separating from the terminal in the removing direction of the die when the die is removed from the electric wire with the terminal after the resin portion is molded.

DESCRIPTION OF REFERENCE NUMERALS AND SIGNS

1, 200 . . . electric wire with terminal, 2 . . . electric wire, 3, 20, 30, 40, 50, 60, 70, 80, 90, 100, 110, 120 . . . terminal, 4 . . . resin portion, 5 . . . insulating coating, 6 . . . terminal connection portion, 7 . . . cylinder portion, 8*a* . . . first connection portion, 8*b* . . . second connection portion, 9 . . . electric wire connection portion, 12 . . . first caulking portion, 13 . . . second caulking portion, 14 . . . bottom wall, 15 . . . side wall, 15*a* . . . parallel side wall, 15*b* . . . slope side wall, 16 . . . groove portion (separation preventing portion), 17 . . . inner face, 21, 31, 41 . . . protrusion portion (separation preventing portion), 32, 42 . . . opening portion, 51 . . . bent portion (separation preventing portion), 61 . . . opening portion (separation preventing portion), 71, 81, 91 . . . (91*a*, 91*b*), 101, 111 . . . opening portion (separation preventing portion), 72, 82, 92, 102, 112 . . . outer face, 73, 83, 93, 103, 113, 123 . . . inner face, 104, 114 . . . lock portion, 105, 115 . . . hole portion, 124 . . . convex portion, 125 . . . concave portion

The invention claimed is:

1. An electrical connection system comprising:

an electric wire, a terminal having a conductor exposure portion, to which a conductor of the electric wire is connected, and a separation preventing portion, a resin portion, which is molded by a die, and covers the conductor exposure portion and the separation prevention portion of the terminal, wherein the separation preventing portion is provided on an inner face of a side wall of the terminal at a part of the terminal covered with the resin portion so that after the resin portion is molded by the die, the separation preventing portion prevents the resin portion from separating from the terminal in a removing direction of the die.

2. The electrical connection system according to claim 1, wherein the separation preventing portion is further provided in a bottom wall of the terminal at the part covered with the resin portion.

3. The electrical connection system according to claim 1, wherein the separation preventing portion includes a groove portion or a protrusion portion which is formed to have a width in the removing direction of the die and to be longer in a direction intersecting with the removing direction of the die than the width.

4. The electrical connection system according to claim 1, wherein the separation preventing portion includes a bent portion which is formed by bending a front end of the side wall of the terminal inward.

5. The electrical connection system according to claim 1, wherein the separation preventing portion has an opening portion which is bored and formed in the side wall of the terminal.

6. The electrical connection system according to claim 2, wherein the separation preventing portion has an opening portion which is bored and formed in the bottom wall of the terminal; and wherein the resin portion is formed so as to enter the opening portion, and formed to cover an outer face of the bottom wall of the terminal.

7. The electrical connection system according to claim 6, wherein a lock portion is formed into an arch shape so as to be joined to opposite ends of the opening portion.

8. The electrical connection system according to claim 3, wherein convex portions or concave portions are formed into a grid pattern in the separation prevention portion and the bottom wall of the terminal.

9. The electrical connection system according to claim 4, wherein convex portions or concave portions are formed into a grid pattern in the separation prevention portion and the bottom wall of the terminal.

10. The electrical connection system according to claim 5, wherein convex portions or concave portions are formed into a grid pattern in the separation prevention portion and the bottom wall of the terminal.

* * * * *